US007832128B2

(12) United States Patent
Doucette et al.

(10) Patent No.: US 7,832,128 B2
(45) Date of Patent: Nov. 16, 2010

(54) DITCH DIGGING BUCKET

(76) Inventors: Rene Doucette, 5811 Victoria Street, Peachland, British Columbia (CA) V0H 1X4; Paul Doucette, 5811 Victoria Street, Peachland, British Columbia (CA) V0H 1X4; Greg Doucette, 5811 Victoria Street, Peachland, British Columbia (CA) V0H 1X4; Guy Doucette, 5811 Victoria Street, Peachland, British Columbia (CA) V0H 1X4

( * ) Notice: Subject to any disclaimer, the term of this patent is extended or adjusted under 35 U.S.C. 154(b) by 428 days.

(21) Appl. No.: 11/988,570

(22) PCT Filed: Jul. 12, 2005

(86) PCT No.: PCT/CA2005/001077

§ 371 (c)(1),
(2), (4) Date: Jan. 10, 2008

(87) PCT Pub. No.: WO2007/006116

PCT Pub. Date: Jan. 18, 2007

(65) Prior Publication Data

US 2010/0115801 A1 May 13, 2010

(51) Int. Cl.
*E02F 3/40* (2006.01)

(52) U.S. Cl. ..... 37/444; 37/411; 37/379; 414/694

(58) Field of Classification Search ..... 37/264, 37/341, 398, 442–444, 903, 411, 379; 414/694
See application file for complete search history.

(56) References Cited

U.S. PATENT DOCUMENTS

| | | | | | |
|---|---|---|---|---|---|
| 293,261 | A | * | 2/1884 | Matcham | 428/581 |
| 1,481,273 | A | * | 1/1924 | Roe | 172/26.5 |
| 1,545,943 | A | * | 7/1925 | Crane | 37/465 |
| 1,573,128 | A | * | 2/1926 | Baker | 37/398 |
| 1,582,577 | A | * | 4/1926 | Crane | 37/444 |
| 1,879,447 | A | * | 9/1932 | Page | 37/398 |
| 2,096,773 | A | * | 10/1937 | Weimer | 37/398 |
| 2,325,336 | A | * | 7/1943 | Mikan | 37/398 |
| 2,480,384 | A | * | 8/1949 | Schwartz | 37/442 |
| 2,525,528 | A | * | 10/1950 | Deal | 37/398 |
| 2,770,076 | A | * | 11/1956 | Kluckhohn | 47/58.1 R |
| 2,959,307 | A | * | 11/1960 | Schwartz | 414/722 |
| 2,972,425 | A | * | 2/1961 | Anderson et al. | 37/379 |
| 3,352,038 | A | * | 11/1967 | Kalve | 37/398 |
| 3,702,509 | A | * | 11/1972 | Zowaski | 37/97 |

(Continued)

*Primary Examiner*—Thomas A Beach
(74) *Attorney, Agent, or Firm*—George A. Seaby

(57) ABSTRACT

A one-pass bucket includes a top wall, a bottom wall, a rear wall and a pair of side walls diverging forwardly from the rear wall to an open front end of the bucket, wherein the curved end walls extend convexly from the bottom wall to the top of the end wall at a forward edge thereof, and extending substantially diagonally upwardly from the bottom at a rearward edge so that the forward edge of the curved end wall curves upwardly towards the plane of the top wall so as to intersect the plane of the top wall non-tangentially and the rearward edge extends diagonally to intersect the plane of the top wall whereby a round bottom ditch is formed by rotating one of the curved end walls down and dragging that curved end wall through the soil longitudinally of the proposed ditch in a single pass.

8 Claims, 28 Drawing Sheets

U.S. PATENT DOCUMENTS

| | | | | | |
|---|---|---|---|---|---|
| 4,037,337 | A | * | 7/1977 | Hemphill | 37/444 |
| 4,133,121 | A | * | 1/1979 | Hemphill | 37/444 |
| 4,251,933 | A | * | 2/1981 | Hemphill | 37/446 |
| 4,314,789 | A | | 2/1982 | Luigi | |
| 4,393,606 | A | | 7/1983 | Wanecke | |
| 4,476,641 | A | * | 10/1984 | Ballinger | 37/444 |
| 4,704,811 | A | * | 11/1987 | Jefferson | 37/364 |
| 4,903,418 | A | * | 2/1990 | Loudon | 37/301 |
| 5,353,531 | A | * | 10/1994 | Doucette | 37/444 |
| 5,815,959 | A | * | 10/1998 | Bahner et al. | 37/444 |
| 5,832,638 | A | * | 11/1998 | Watts | 37/396 |
| 5,901,479 | A | * | 5/1999 | Langdon | 37/444 |
| 5,909,961 | A | * | 6/1999 | Pullman | 37/444 |
| 6,574,890 | B2 | * | 6/2003 | Bateman, Jr. | 37/264 |
| 7,191,553 | B2 | * | 3/2007 | Doucette et al. | 37/444 |
| 2005/0178030 | A1 | | 8/2005 | Doucette et al. | |

* cited by examiner

DITCH DIGGING BUCKET

FIELD OF THE INVENTION

This invention relates to an improved bucket for use on a mechanical digging apparatus, such as an excavator, having an articulatable boom on the end of which may be mounted a conventional bucket.

BACKGROUND OF THE INVENTION

When a road is cut in the side of a hill or mountain, drainage ditches are usually required to carry away water flowing down the hill or mountain towards the road. Such ditches usually have a V-shaped cross-sectional configuration which tends to concentrate water into a small area of the ditch increasing the likelihood of erosion. With a view to reducing or preventing erosion, it is preferable that the bottom of drainage ditches be round so that the flow of water is spread over a greater area, without under-cutting the embankment.

Round bottom ditches have conventionally been cut using excavators, backhoes or other mechanical digging machines having extensible or articulated booms to the distal ends of which are mounted buckets of known type. The machine is parked on the shoulder of a road, the boom and bucket is extended toward the proposed ditch area, the bucket is dropped or forced downwardly into the soil and curled inwardly and the boom is simultaneously retracted. The process is repeated two or three times. During the first pass or passes, the soil is disrupted. The number of such passes required to loosen the soil is dictated by a number of factors including the nature or rockiness of the soil, its compaction, the angle of attack of the edge of the bucket engaging the soil, the available power of the machine which may be applied downwardly on the bucket, and so on. The last pass or passes serve to scoop and clear the loosened soil. Completion of the passes may be considered as a cycle. In the case of conventional square sided buckets, with each cycle a ditch segment the width of the bucket is completed. Conventional square sided buckets are approximately five feet wide, and accordingly each cycle produces approximately five feet of ditch. At the usual speeds, a round bottomed ditch can be produced at a rate of approximately 50 lineal meters (approximately 150 feet) per hour.

The conventional ditch digging method described above with respect to square sided buckets suffers from the disadvantage that the simultaneous curl and retraction of the boom and bucket must be controlled accurately which may be difficult for an inexperienced operator. If the curl and retraction are not accurately controlled, the ditch may be over-cut resulting in undermining and premature ditch erosion. Moreover, in order to cut a ditch using the conventional method, the body of the digging apparatus must be swung out into the roadway which results in a hazard to traffic passing on the roadway. Additionally, after each cycle the machine must be moved along the road so as to present the bucket parallel to the road for the next adjacent five foot segment.

It was consequently an improvement in the art of digging ditches to introduce the apparatus which formed the subject of U.S. Pat. No. 5,353,531, which issued to Doucette on Oct. 11, 1994 for an invention entitled Ditch Digging Apparatus and Method. That patent disclosed and claimed the use of a so-called "two-pass" bucket having a square lower corner at one end of the bucket and a curved lower corner at the opposite end of the bucket. When used on a Gradall™-type machine, that is a machine able to rotate the bucket one hundred eighty degrees about the longitudinal axis of its telescopic boom, the square corner was used to loosen the soil on a first pass and the round corner to scoop a round bottom ditch on the second pass. In particular that invention related to a bucket for use on a mechanical ditch digging apparatus where the bucket included top wall means; bottom wall means; rear wall means extending between the top wall means and the bottom wall means; first side wall means extending forwardly from one end of the rear wall means and interconnecting one end of the top wall means and one end of the bottom wall means; and second side wall means extending forwardly from the other end of rear wall means and interconnecting the other end of the top wall means and the other end of the bottom wall means. The top wall means, bottom wall means and side wall means were disclosed as having front edges defining an open front end for receiving earth; the first side wall means defining a square corner with the one end of the bottom wall means, whereby the bracket could be dragged through the earth with the angular corner extending downwardly to form an angular ditch; and the second side wall means defined a convex corner at the other end of the bottom wall means. Thus, when the bucket was rotated one hundred eighty degrees around a longitudinal axis generally parallel to the boom and extending between the side walls, the convex corner extended downwardly for dragging through the angular ditch to form a round bottom ditch.

SUMMARY OF THE INVENTION

In summary, in a first embodiment the bucket of the present invention may be characterized as a one-pass bucket (30) for use on the end of an actuable arm on a mechanical ditch digging apparatus for digging a ditch parallel to a roadway, the bucket comprising a top wall (32); a bottom wall (40); a rear wall (34,38) integral with the bottom wall, the rear wall and the bottom wall defining a curve (a') extending downwardly and forwardly from a rear edge (32*a*) of the top wall to an open front end of the bucket; a first side wall (36) extending forwardly from a first end (38*b*) of the rear wall and interconnecting a first end of the top wall (32*b*) and a corresponding first end (40*a*) of the bottom wall; and, a curved end wall (42) opposite the first side wall (36), the curved end wall (42) extending forwardly from an opposite second end (38*c*) of the rear wall, opposite the first end of the rear wall, and interconnecting an opposite second end (32*c*) of the top wall, opposite the first end of the top wall; and an opposite second end (40*b*) of the bottom wall, opposite the first end of the bottom wall, the curved end wall having opposite curved bottom (46*a*) and top (46*b*) ends, the first side wall diverging forwardly (angle δ) from the rear wall; the top wall, the bottom wall and the first side wall having forward edges (32*d*, 40*a*, 36*b*) defining an open front end (30*a*) of the bucket for receiving earth; the first side wall defining an acutely-angular corner (angle θ') with the first end of the bottom wall, whereby the bucket may be dragged through the earth with the acutely-angular corner (angle θ') extending downwardly to break-up particularly densely compacted soil and rock material, the curved end wall defining a convexity (42*a*) extending tangentially from the second end (40*b*) of the bottom wall, the convexity (42*a*) tapering rearwardly toward the rear wall (34, 38), and when viewed in front elevation the curved end wall (42) extending convexly from the bottom wall (40) to the top end (46*b*) at a forward edge (46) thereof, and extending substantially diagonally upwardly therefrom at a rearward edge (44) so that the forward edge (46) of the curved end wall (42) curves upwardly towards the plane of the top wall (32) so as to intersect it non-tangentially, for example generally orthogonally, and the rearward edge (44) extends diagonally (angle α) to intersect the plane of the top wall (32), whereby a round bottom ditch is formed by rotating the curved end wall (42) downwardly relative to the acutely angled corner (angle θ') and dragging the curved end wall (42) through the soil longitudinally of the proposed ditch, often in a single pass, wherein, when the front opening of the bucket is viewed in front elevation (FIG. 4), the bottom wall (40), the rear wall (34, 38), the first side wall (36), and the first end of the top wall (32*b*) define a first portion of the bucket having a first longitudinal axis (C) substantially parallel to and substantially equi-distant between the top and bottom walls; and, the curved end wall (42) and the second end (32*c*) of the top wall define a second portion of the bucket having a second longitudinal axis (D), and wherein the first and second longitudinal axes (C, D) intersect substantially on the rearward edge (44) of the curved end wall (42), and wherein the second longitudinal axis (D) diverges downwardly (angle Δ) from colinearity with the first longitudinal axis (C), and wherein the curved bottom end (46*a*) of the curved end wall (42) intersects the bottom wall (40) generally half-way (ratio f/k) along a length (k) corresponding to generally the length of the top wall (32), and wherein, when the bucket is viewed from a plan view, the curved end wall (42) diverges forwardly from the rear wall (34, 38) at an angle (angle p) greater than the angle (angle δ) at which the first side wall (36) diverges forwardly from the rear wall (34, 38), and the forward edges of the bottom wall (40) and the curved bottom end (46*a*) of the curved end wall (42) extend forwardly (distance u) of the forward edge (32*d*) of the top wall (32), and the forward edge (46) of the curved end wall (42) slopes rearwardly (angle β), and downwardly (angle π') when viewed in side elevation view (FIG. 6), from intersecting the forward edge of the bottom wall (40), at the curved bottom end (46*a*), to the top end (46*b*) so that the forward edge of the top end (46*b*) of the curved end wall (42) cuts back and down to intersect the forward edge of the top wall (32), and wherein the curved end wall including a longitudinal outermost tip (46') of the curved end wall (42), extends longitudinally (collinear with axis C) beyond a corresponding end (32*c*) of the top wall (32).

In a second embodiment, the bucket of the present invention may be characterized as a double-ended one-pass bucket (130) for use on the end of an actuable arm on a mechanical ditch digging apparatus for digging a ditch parallel to a roadway, the bucket comprising a top wall (132); a bottom wall (138); a rear wall (134,136) integral with the bottom wall, the rear wall and the bottom wall defining a curve (a") extending downwardly and forwardly from a rear edge (132*d*) of the top wall to an open front end of the bucket; a left side curved end wall (140) extending forwardly from a rear edge (140*b*) of the curved end wall (140) and interconnecting a left or first end of the top wall (132*b*) and a corresponding end (138*b*) of the bottom wall (138); and, a right side curved end wall (142) opposite the left side curved end wall (140), the right side curved end wall (142) extending forwardly from a rear edge 142*b* opposite the rear edge (140*b*), and interconnecting an opposite right or second end (132*c*) of the top wall, opposite the first end (132*b*) of the top wall (132), and an opposite end (138*c*) of the bottom wall (138) the right side curved end wall (142) having opposite curved bottom (142*a*) and top (142*d*) ends, the left and right side curved end walls (140,142) diverging forwardly by angle p from the rear wall (134); the top wall (132), the bottom wall (138) and the left and right side curved end walls (140,142) having, respectively, forward edges (132*a*, 138*a*, 140*a* and 142*a*) defining a front end opening (130*a*) of the bucket (130) for receiving earth;

each of the left and right side curved end walls defining a convexity (140*c*, 142*e*) extending tangentially from, respectively, the first end (138*b*) and the second end (138*c*) of the bottom wall (138), each convexity (140*c*, 142*c*) tapering rearwardly toward the rear wall (134, 136, and when viewed in front elevation the curved end walls (140,142) extending convexly at the bucket opening (130*a*), from the bottom wall (138) to the top wall (132), and extending substantially diagonally upwardly therefrom at their rearward edges (140*b*, 142*b*) so that the forward edges (140*a*, 142*a*) of the curved end walls (140, 142) curve upwardly towards the plane of the top wall (132) so as to intersect the top wall (132) non-tangentially, for example generally orthogonally, and the rearward edges (140*b*, 142*b*) extend diagonally at angle α to intersect the plane of the top wall (132), whereby a round bottom ditch may be formed by rotating either curved end wall (140 or 142) downwardly relative to the coupler (152) coupling the bucket (130) to the stick (54), and dragging the lowered curved end wall (140 or 142) through the soil longitudinally along the proposed ditch (66), often in a single pass, wherein, when the front opening (130*a*) of the bucket (130) is viewed in front elevation, the bottom wall (138), the rear wall (134, 136), and the first end of the top wall (132*b*) define a central portion (128) of the bucket having a first longitudinal axis (C') substantially parallel to and substantially equi-distant between the top and bottom walls (132, 138); and, the left and right curved end walls (140, 142), and the first and second ends (132*b*, 132*c*) of the top wall (132) define, respectively, left and right portions (126*a*, 126*b*) of the bucket (130), each left and right portion having a longitudinal axis (D') wherein the two longitudinal axes D' form an oppositely disposed pair of end longitudinal axes, and wherein the central and end longitudinal axes (C', D') intersect substantially on the corresponding rearward edges (140*b*, 142*b*) of their respective curved end walls (140, 142), and wherein the end longitudinal axes (D') diverge downwardly at angle Δ' from colinearity with the central longitudinal axis (C'), and wherein the left and right curved bottom ends (140*e*, 142*e*) of the curved end walls (140, 142) intersect the bottom wall (138) each generally one third of the distance (ratio f'/k') along a length (k') corresponding to generally the length of the top wall (132), and wherein, when the bucket is viewed in plan view, the curved end walls (140, 142) diverge forwardly from the rear wall (134) at an angle (angle ρ) and the forward edge (138*a*) of the bottom wall (138) and the curved bottom ends (140*e*, 142*e*) of the curved end walls (140, 142) extend forwardly a distance u' of the forward edge (132*a*) of the top wall (132), and the forward edges (140*a*, 142*a*) of the curved end walls (140, 142) slope rearwardly (angleβ'), and downwardly (initially at angle π) when viewed in side elevation view, from intersecting the forward edge (138*a*) of the bottom wall (138), at the curved bottom ends (140*e*, 142*e*), to the top ends (140*d*, 142*d*) so that the forward edge of the top ends (140*d*, 142*d*) of the curved end walls (140, 142) cuts back and down to intersect the forward edge (132*a*) of the top wall (132), and wherein the curved end walls (140, 142), including a longitudinally outermost tips (140*h*, 142*h*) of the curved end walls (140, 142), extend longitudinally (parallel to axis C') beyond corresponding left and right ends (132*b*, 132*c*) of the top wall (132).

BRIEF DESCRIPTION OF THE DRAWINGS

What follows below is with reference to the drawings, wherein similar characters of reference denote corresponding parts in each view.

DETAILED DESCRIPTION OF EMBODIMENTS OF THE INVENTION

Figure 3:
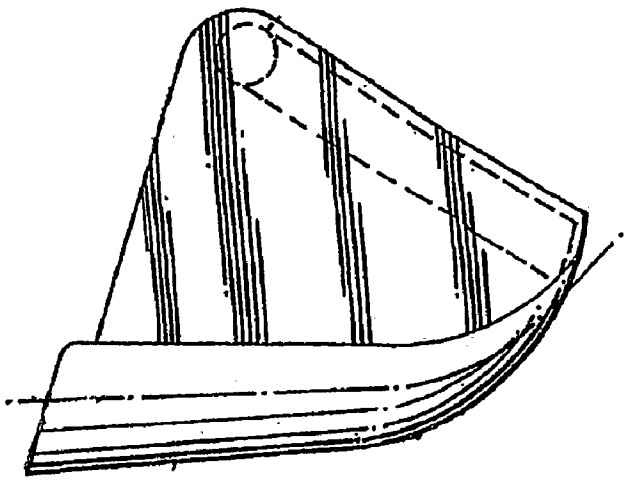
FIG. 3 is the prior art bucket of FIG. 1 in right side elevation view.
Figure 1:
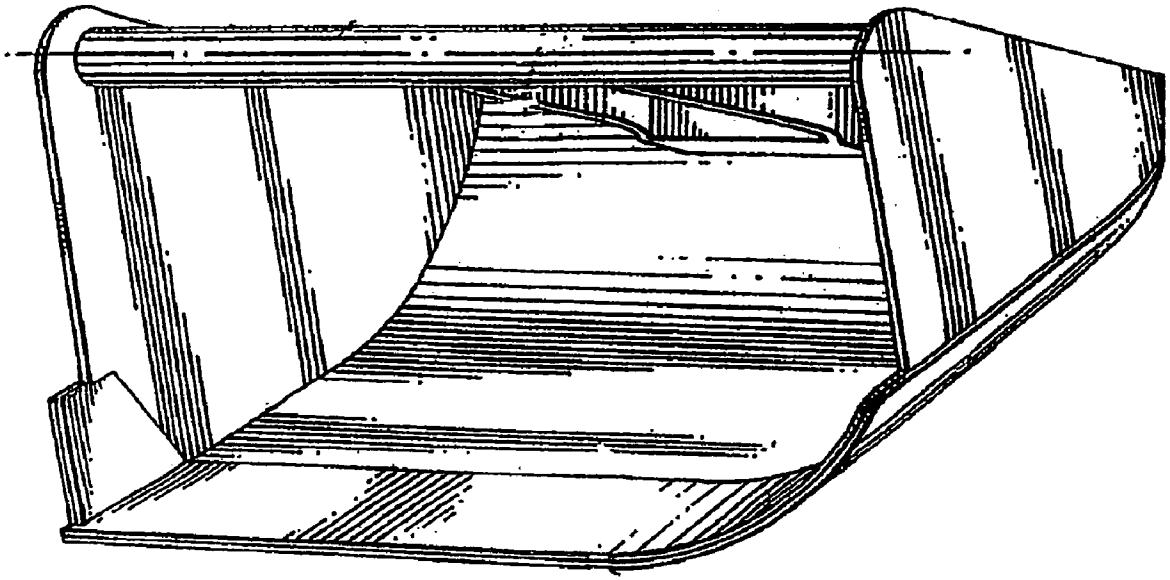
FIG. 1 PRIOR ART
FIG. 1 is, in perspective view, a prior art ditch digging bucket.
Figure 2:
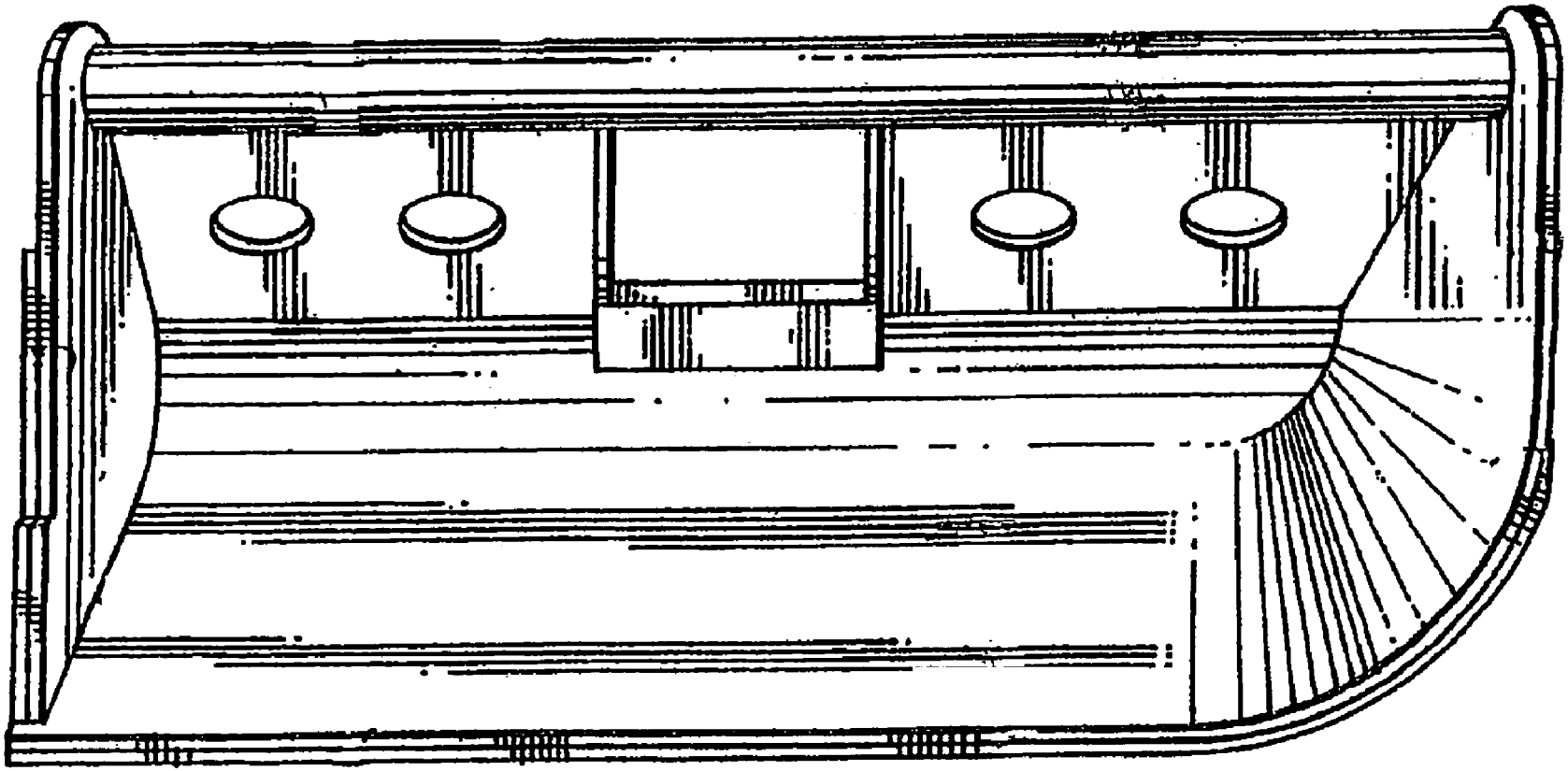
FIG. 2 PRIOR ART
FIG. 2 is the prior art bucket of FIG. 1 in front elevation view.

A prior art bucket is illustrated in FIGS. 1-3. A square corner is formed at the bucket opening between one side wall 5 and the bottom wall of the bucket. The square corner is used to cut a generally V-shaped or angular ditch in the ground when the bucket is dragged through the soil with the corner extending downwardly. The bucket's opposite side wall includes a curved portion. The curved portion is convex and extends outwardly from the rear wall of the bucket so as to define a convex arc or corner on the exterior of the bucket.

In operation the vehicle to which prior art bucket is mounted is positioned on one side of a roadway so that the axles of the Gradall™ wheeled vehicle are perpendicular to the longitudinal axis of the roadway. In this position, the boom of the vehicle can be extended at an angle to the longitudinal axis of the roadway with only a small portion of the vehicle extending into the roadway. The boom is fully extended and the bucket is rotated so that the angular corner extends downwardly towards the soil. The boom is actuated to push the bucket downwardly into the soil, and the boom is retracted to cut a V-shaped ditch. Once the V-shaped ditch has been cut, the bucket is removed from soil and the boom is fully extended. The bucket is rotated through one hundred eighty degrees, so that the curved portion of the side wall extends downwardly. The distal end of the boom is lowered, and the curved portion positioned to cut a round bottom in the ditch. The boom is retracted to cut an approximately twelve feet long round bottom ditch, that is, to clear away a portion of the side of the ditch and to form the round bottom in the ditch. Thus, with the vehicle in position, a length of round bottom ditch is produced with two passes of the bucket over and through the soil; namely a first pass to cut a length of V-shaped ditch and the second pass to scoop-out and form a length of round bottom ditch generally coinciding with the span of the boom. The two passes constitute one cycle in the formation of the length of ditch, and thus one length of ditch is formed upon completion of each cycle. The length of ditch formed during each cycle is determined by the amount by which the boom can be retracted, which for Gradall™ vehicles is determined by the telescopic length of the boom, usually twelve feet.

The present invention is an improvement over the prior art in that the bucket provides for digging a round bottom ditch often with only a single pass so as to increase or even double the rate of ditch excavation to for example 200 lineal meters per hour, and advantageously when used in conjunction with a conventional excavator as an attachment pivotally mounted on the distal end of the stick.

Figure 4:
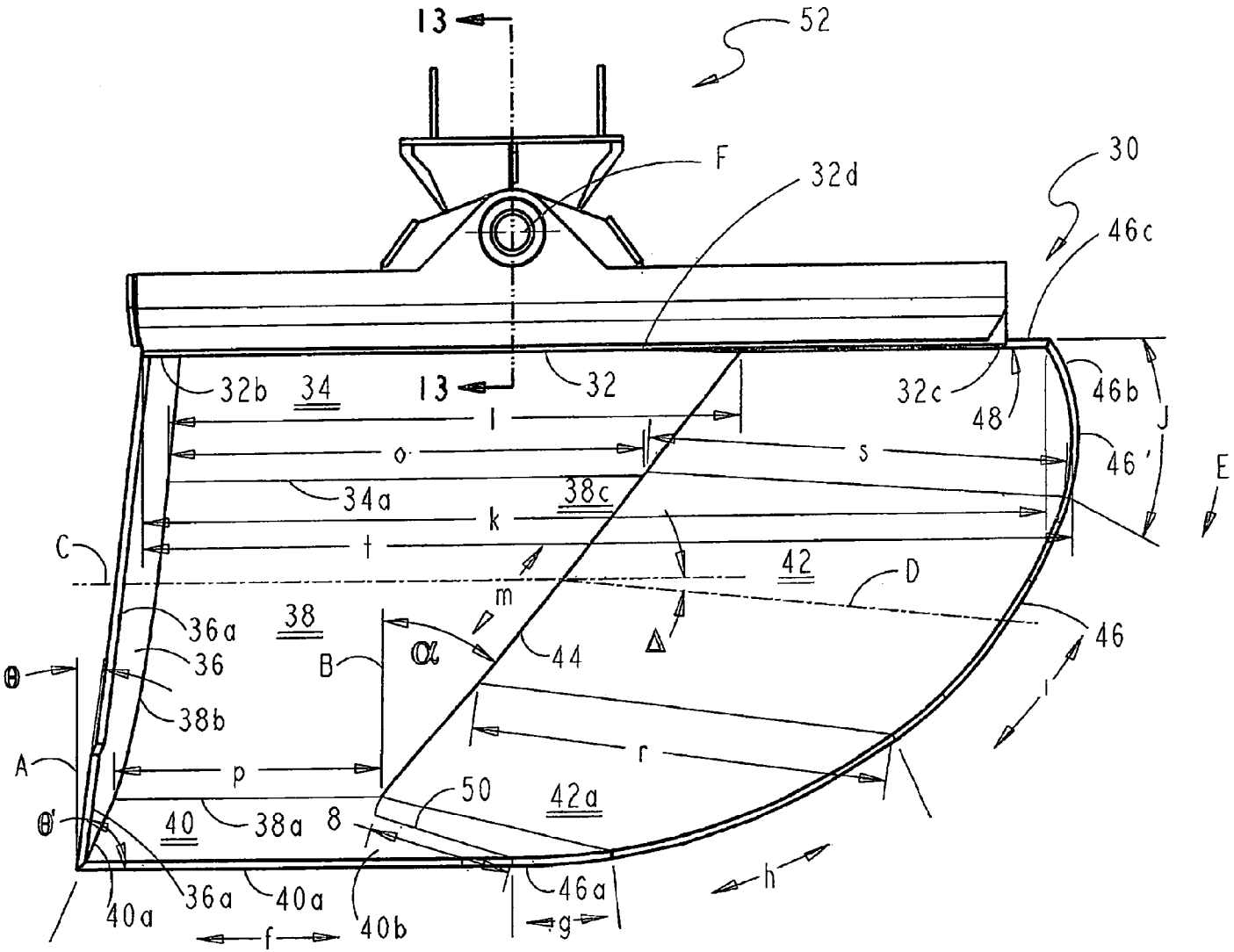
FIG. 4 is, in front elevation view, the ditch digging bucket according to one embodiment of the present invention.

Thus as seen in FIG. 4, one-pass bucket 30 has a planar top wall 32, a planar rear wall 34, a left side planar wall 36, a curved lower wall 38, a generally planar bottom wall 40, and a curved end wall 42. Left side planar wall 36 is not orthogonal to bottom wall 40 but rather forms an angle θ relative to a plane A which is orthogonal to bottom wall 40 and intersects the seam between left side wall 36 and top wall 32. Rear wall 34 is bounded on three sides by linear seams formed between rear wall 34 and top wall 32, left side wall 36, and lower wall 38 respectively. Rear wall 34 and lower wall 38 may also be formed of a unitary piece, and lower wall 38 and bottom wall 40 may also be formed of a unitary piece so long as in side elevation view they generally or substantially form the curvature of the bucket as illustrated by way of example in FIG. 6. Lower wall 38 is bounded on three sides by rear wall 34, left side wall 36, and bottom wall 40. The fourth and right sides of rear wall 34, lower wall 38, and bottom wall 40 are bounded by the left hand and bottom edge of curved end wall 42 respectively.

In particular, the left edge 44 of curved end wall 42 is generally diagonally upwardly inclined when viewed in front elevation and forms an angle α between left edge 44 and a plane B orthogonal to rear wall 34, lower wall 38, and bottom wall 40. The right edge 46 of curved end wall 42, that is the edge opposite from left edge 44, forms, when viewed in front elevation, a complex curve which at its lower end 46*a* is generally tangent to bottom wall 40 and at its upper end 46*b* completes the scalloped or scooped lip of curved end wall 42 as it intersects non-tangentially for example generally orthogonally, with the top wall 32. Curved end wall 42, although illustrated as formed of six contiguously seamed segments, is not intended to be so limited in its various embodiments. That is, curved end wall 42 may be formed of one continuous curved sheet having no flat spots or may be segmented by a plurality of curved or planar plate segments welded together along their adjacent seams so as to form one contiguous generally curved sheet member having flat spots.

Top wall 32, rear wall 34, lower wall 38, bottom wall 40, and left side wall 36 may be characterized as forming a first bucket portion having a longitudinal axis C which extends parallel and generally equi-distant between top wall 32 and bottom wall 40. Curved end 42 may be characterized as forming a second bucket portion having its own longitudinal axis D which extends perpendicularly, when viewed in front elevation, from left edge 44 at the intersection with longitudinal axis C so as to form the angle Δ therebetween and so as to extend generally parallel between the upper and lower edges 48 and 50 respectively of curved end wall 42. As may be seen perhaps best in FIG. 4, longitudinal axes C and D of, the first and second portions of bucket 30 so defined are not collinear respectively, but rather, the second portion of the bucket formed by curved end wall 42 forms a shovel or scoop having a principle axis declined or diverging or otherwise dropped downwardly relative to the first portion of the bucket. Thus, with a bucket coupler 52 such as Twist-A-Wrist™ pivotable coupler mounted to the distal end of an excavator stick 54 as better seen in FIGS. 10 and 11, bucket 30 may be rotated in direction E about the pivot axis F of coupler 52 so as to rotate curved end wall 42 downwardly relative to stick 54 while simultaneously rotating the first portion of the bucket upwardly. Thus rotation about axis F forms a first degree of freedom for rotational movement of bucket 30. Of course, a second degree of freedom is provided by the conventional scooping motion of the bucket toward the cab of the excavator about axis G. Other degrees of freedom of motion are provided by the extension and retraction and swiveling of stick 54 and boom 56 relative to the base 58 of the excavator and by translation of the excavator on its tracks forwardly or rearwardly as for example parallel to roadway 60 while translating the excavator along shoulder 62.

Figure 5:
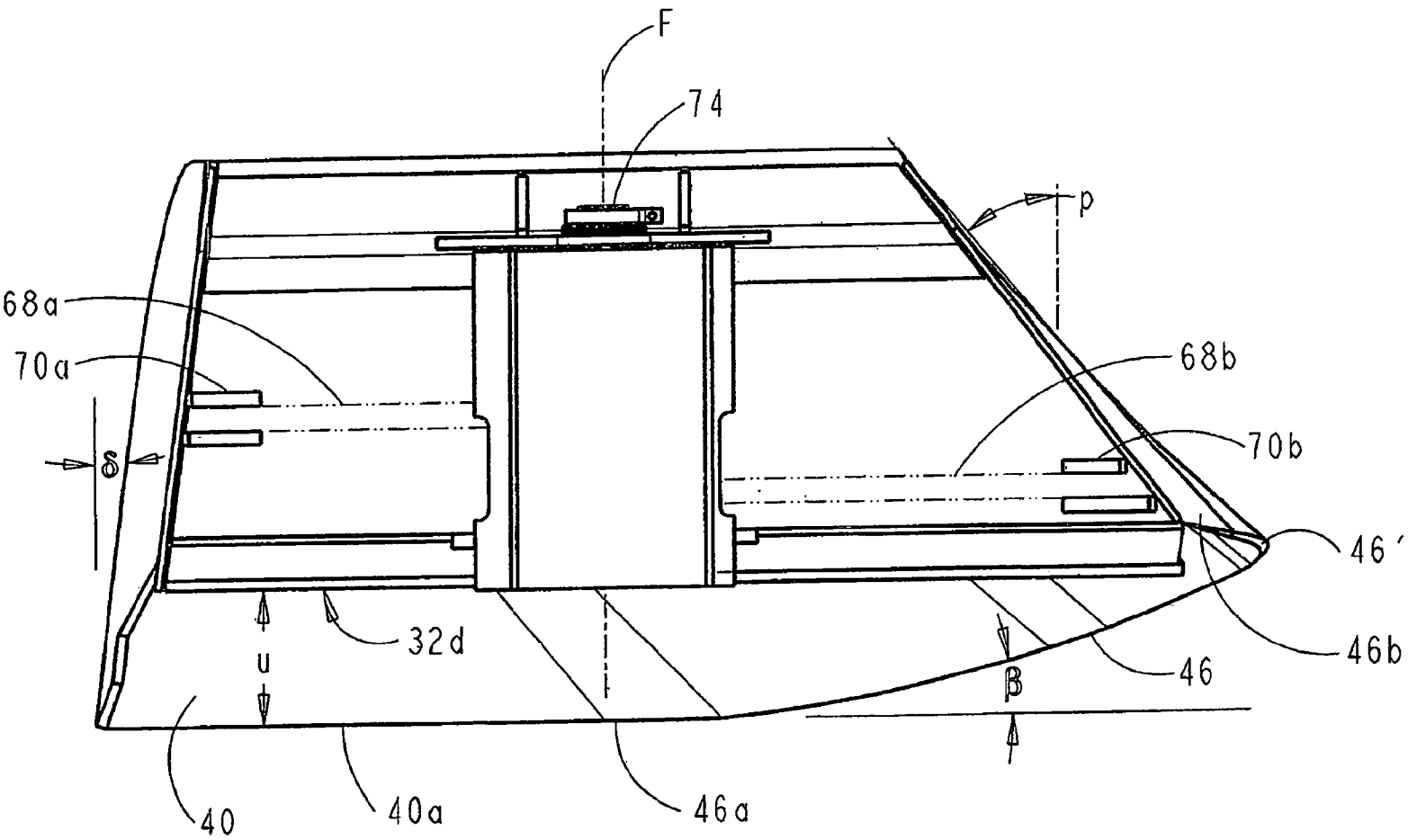
FIG. 5 is, in plan view, the bucket of FIG. 4.
Figure 6:
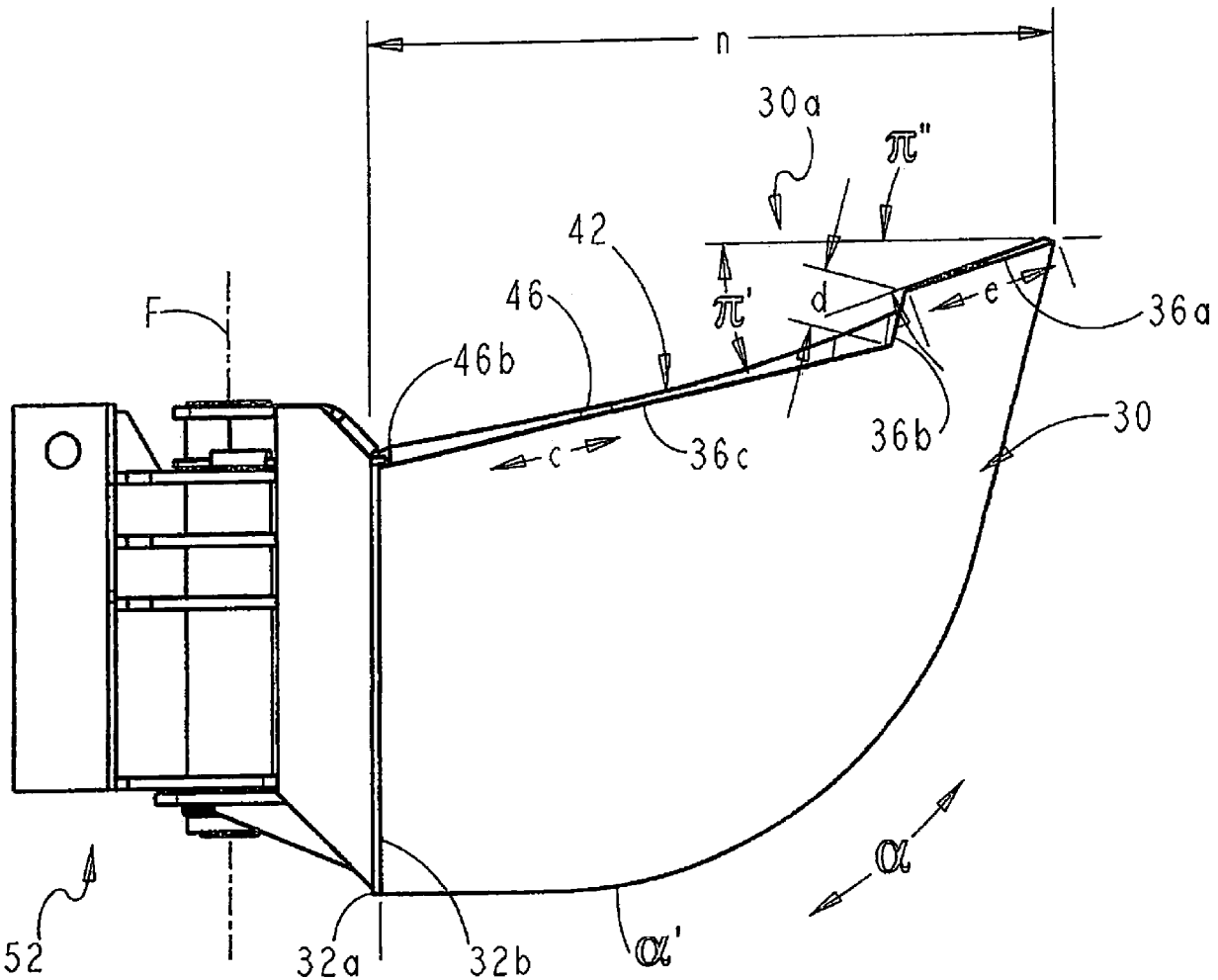
FIG. 6 is, in left side elevation view, the bucket of FIG. 4.
Figure 7:
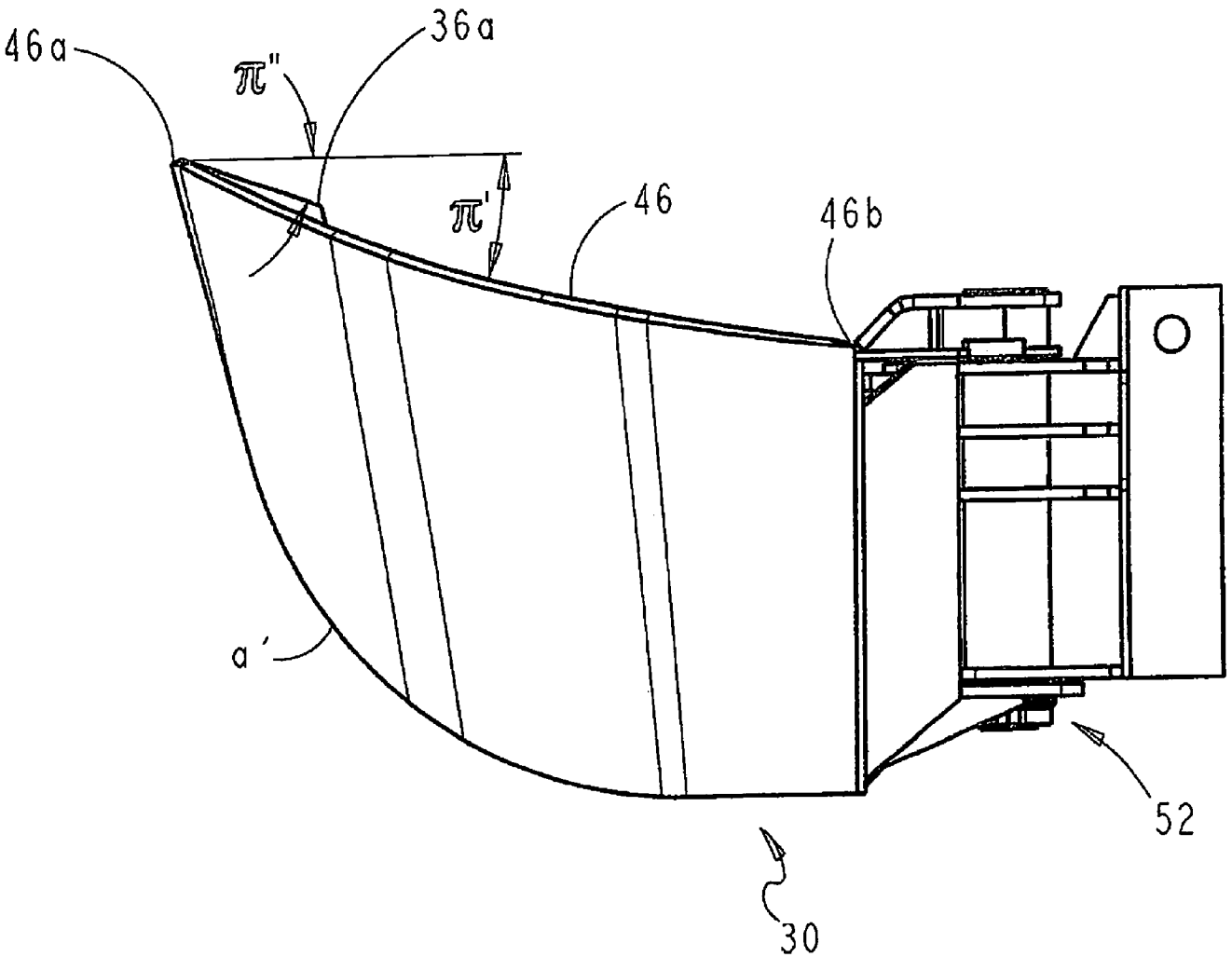
FIG. 7 is, in right side elevation view, the bucket of FIG. 4.
Figure 8:
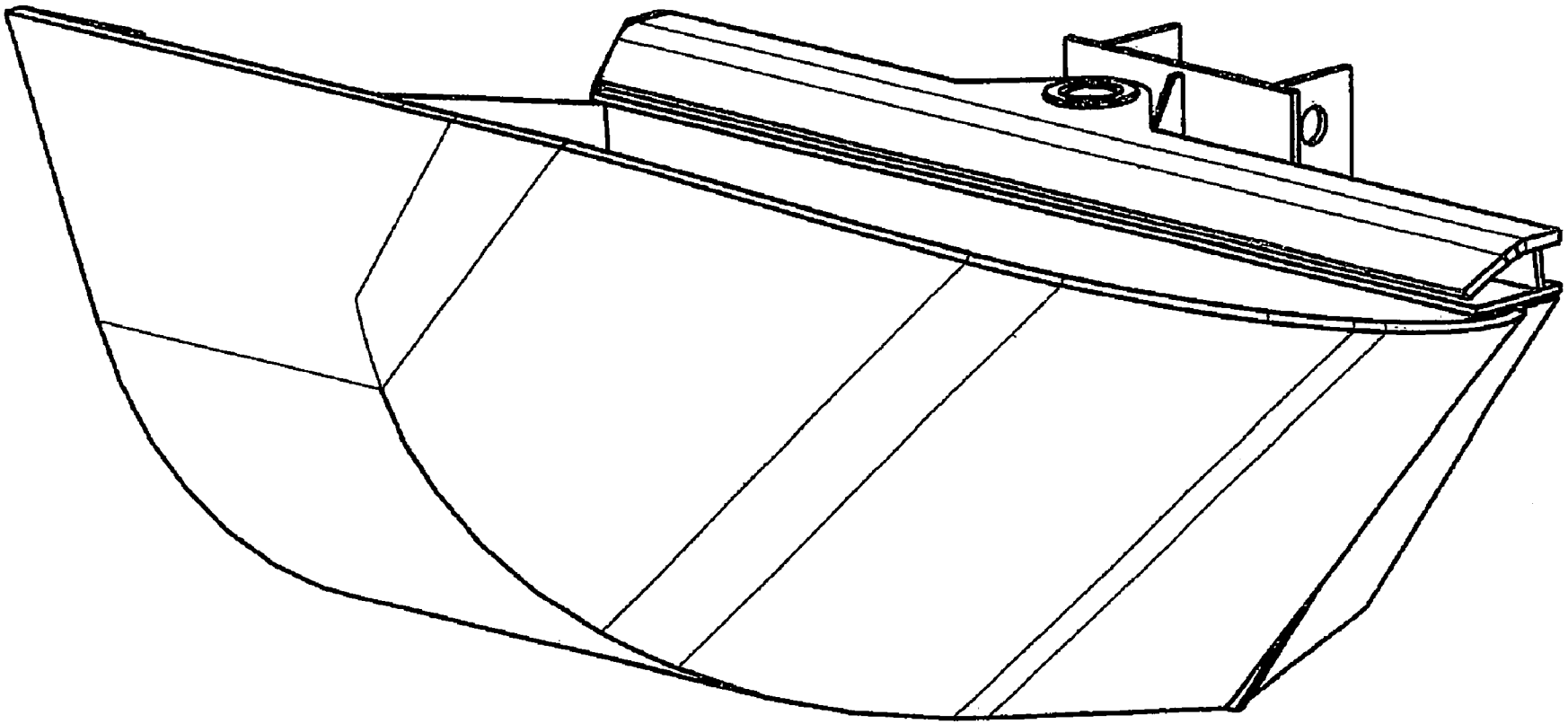
FIG. 8 is, in right side perspective view, the bucket of FIG. 4.
Figure 9:
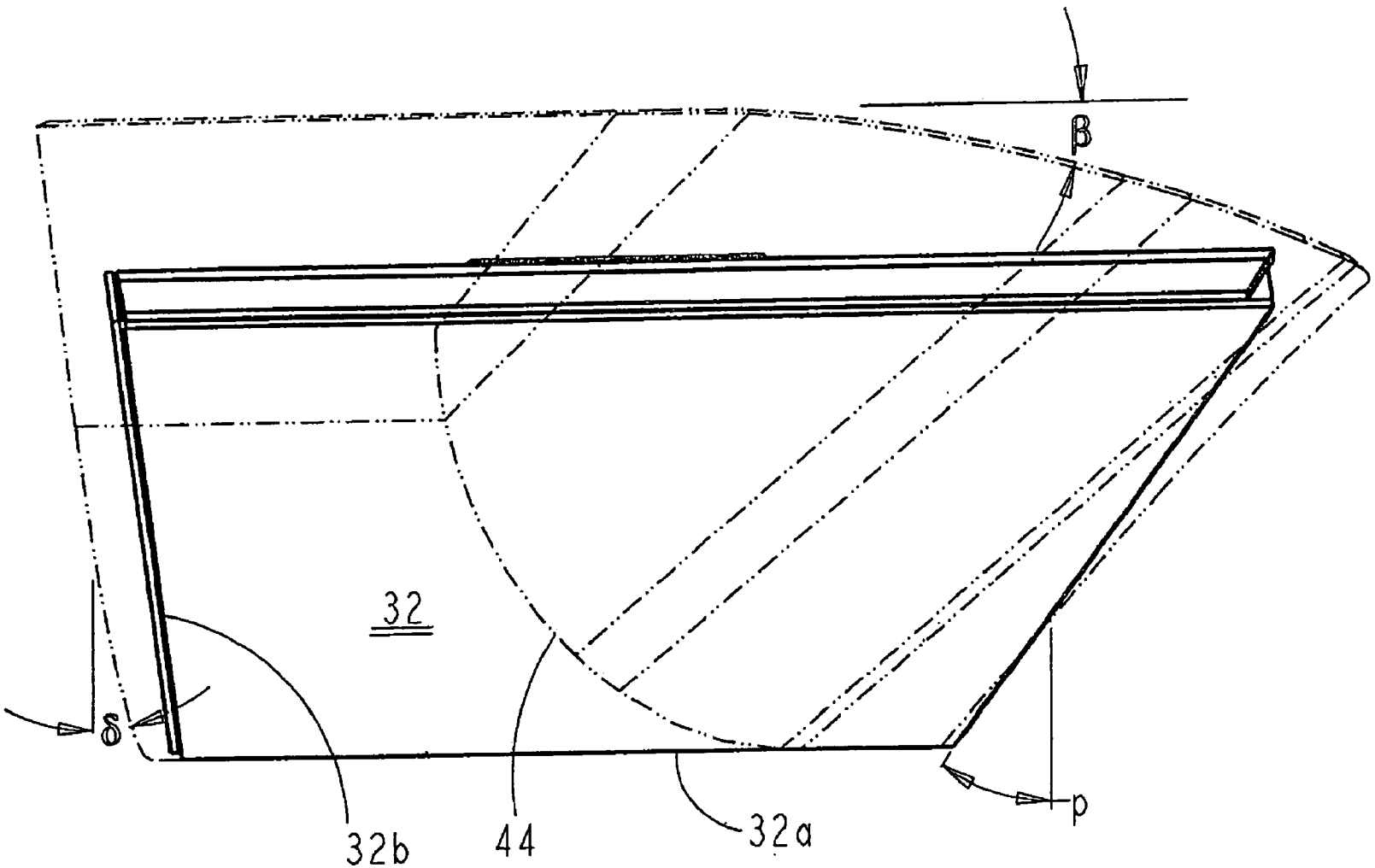
FIG. 9 is, in bottom view, the bucket of FIG. 4 showing the top plate in solid outline and the remainder of the bucket in dotted outline.

As seen in FIG. 5, right-hand curved edge 46 also forms angle β, when viewed in plan view, with a line extending linearly from front edge 40*a* of bottom wall 40. Also, when viewed in left side elevation, as seen in FIG. 6, curved edge 46 forms an angle π' with the horizontal which angle varies because of the slight curvature in that view of curved edge 46, but which generally is twenty-three degrees. Similarly, front edge 36*a* of left side 36 forms an angle π' of generally eighteen degrees with the horizontal. The forward-most edge of left side 36 may also include a cut back or notch 36*b* which then drops the remainder of the forward-most edge 36*c* closer to the horizontal.

What follows are dimensions representative of a preferred embodiment which, although not intending to be limiting, will provide to those skilled in the art guidelines representative of the scaleable proportions of the various parts of the bucket. Thus as seen in FIG. 6, dimension a, which is the curved profile when viewed in left side elevation of the back and bottom of the bucket, may be fifty inches. The depth of the bucket illustrated as dimension b in FIG. 6 may be twenty-nine inches. The front edge dimensions of left side wall 36 may be broken down into three dimensions c, d and e, respectively fourteen inches, five inches and nine inches. Referring to FIG. 4, and commencing with the front left hand lowermost corner of the bucket opening 30*a*, dimension f, which extends along the front edge of bottom wall 40, may be fifty-five inches. Dimension g, the length of lower end 46*a* of curved edge 46, may be nine inches. An adjacent segment of curved edge 46 indicated by dimension h, may be nineteen inches. The adjacent segment of curved edge 46 indicated by dimension i may be twenty-nine inches. Finally, the adjacent segment of curved edge 46 including upper end 46*b*, indicated by dimension j, may be fourteen inches. The total length of top wall 42, including the right edge protrusion 46*c*, as indicated by dimension k may be seventy-four inches.

Inside the bucket itself, dimension l may be forty-two inches (the dimension between left wall 36 left edge 44 along top wall 32), dimension m may be forty inches (the length of left edge 44 measured so as to follow the curvature of the rear of the bucket); angle Δ may be in the order of twenty-seven degrees (although other angles formed between axes C and D, for example within the range of twenty to thirty-five degrees depending on the available range of angular rotation about axis F, fall within the scope of the present invention), dimension n seen in FIG. 6 may be thirty-four and one half inches (the height of the open front face of the bucket), dimension o may be thirty-nine inches (the length of seam 34*a* between rear wall 34 and lower wall 38 as that seam extends between the intersection with left wall 36 and left edge 44), and dimension p may be twenty-nine inches (the length of seam 38*a* between lower wall 38 and bottom wall 40 as it extends from the intersection with left wall 36 and left edge 44). Within the curved end portion of the bucket 30, the length dimensions extending from left edge 44 to curved edge 46 are illustrated as adjacent dimension lines q which may be twenty-four and one half inches, r which may be thirty-three and one half inches, and s which may be forty inches. Dimension t indicates the length of bucket 30 at its greatest when viewed in front elevation. Dimension t may be seventy-five inches. Angle α may be approximately twenty-seven degrees, and angle θ may be about five degrees. Angle p may be thirty-five degrees.

Figure 10:
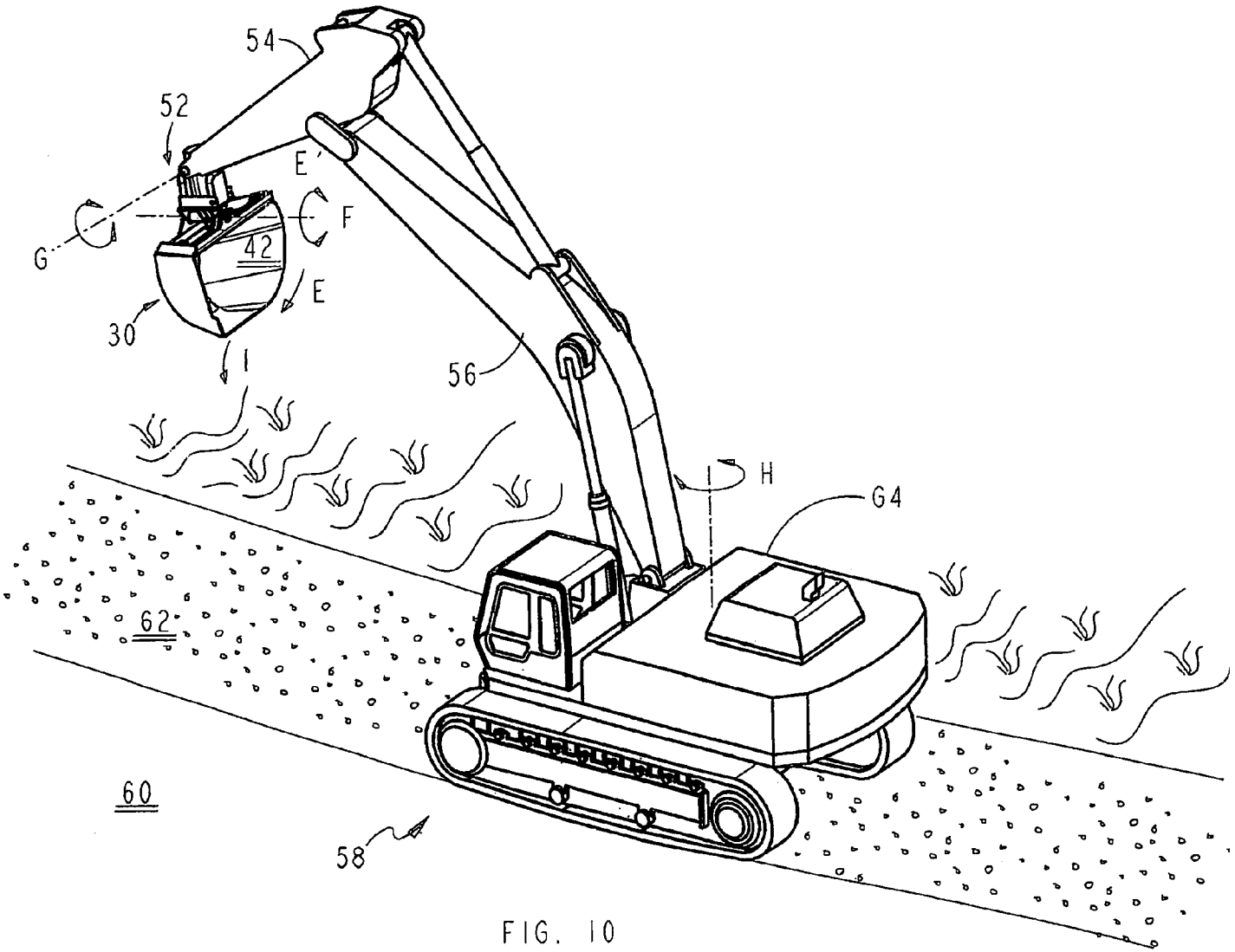
FIG. 10 is, in perspective view, the bucket of FIG. 4 mounted on an excavator.
Figure 11:
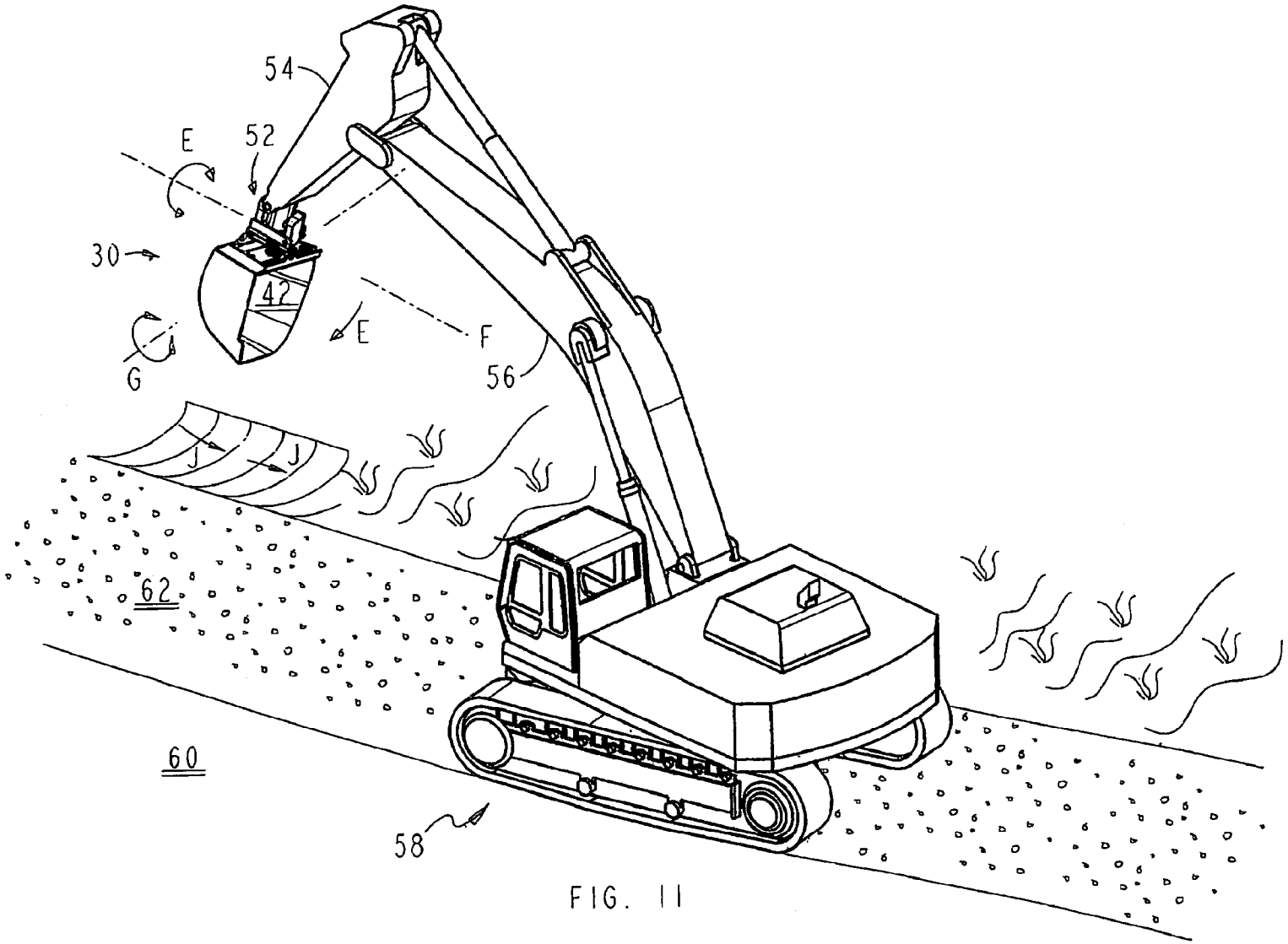
FIG. 11 is the view of FIG. 10, with the bucket lowered and ready to be dragged through the ground along a roadway shoulder so as to excavate a ditch.
Figure 12:
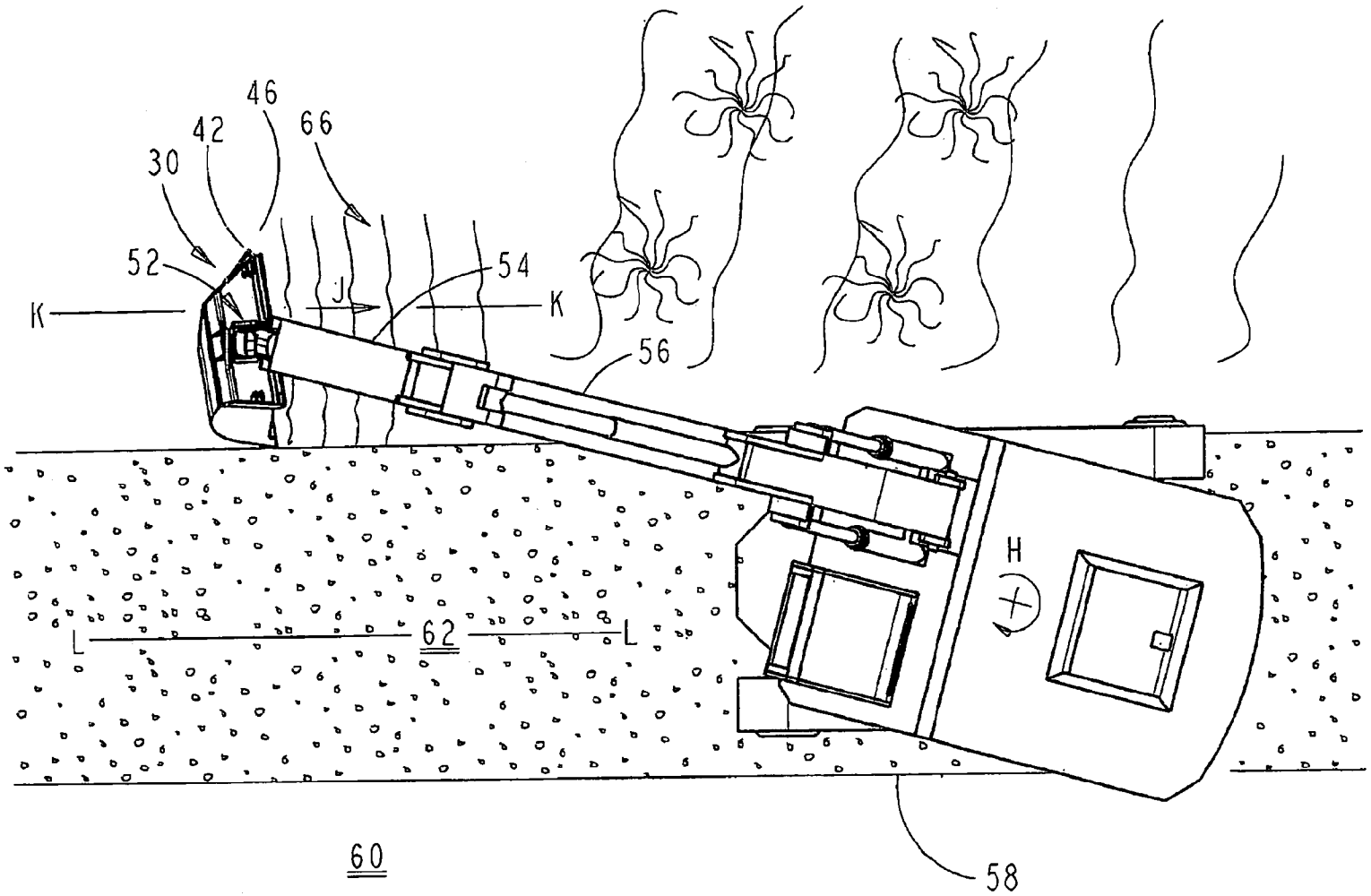
FIG. 12 is the excavator and bucket of FIG. 11, in plan view.
Figure 13:
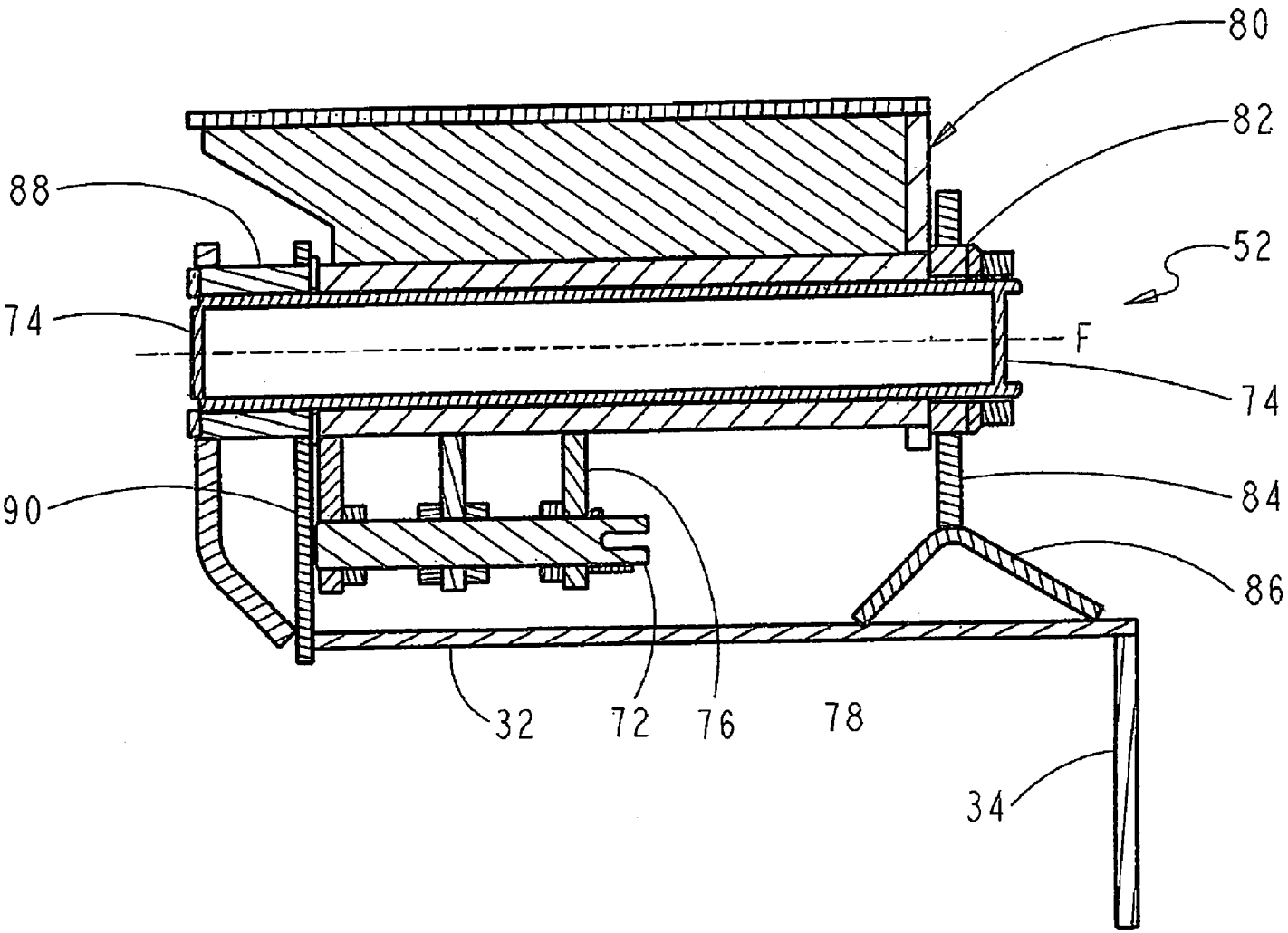
FIG. 13 is a cross-sectional view along line 13-13 in FIG. 4.
Figure 14:
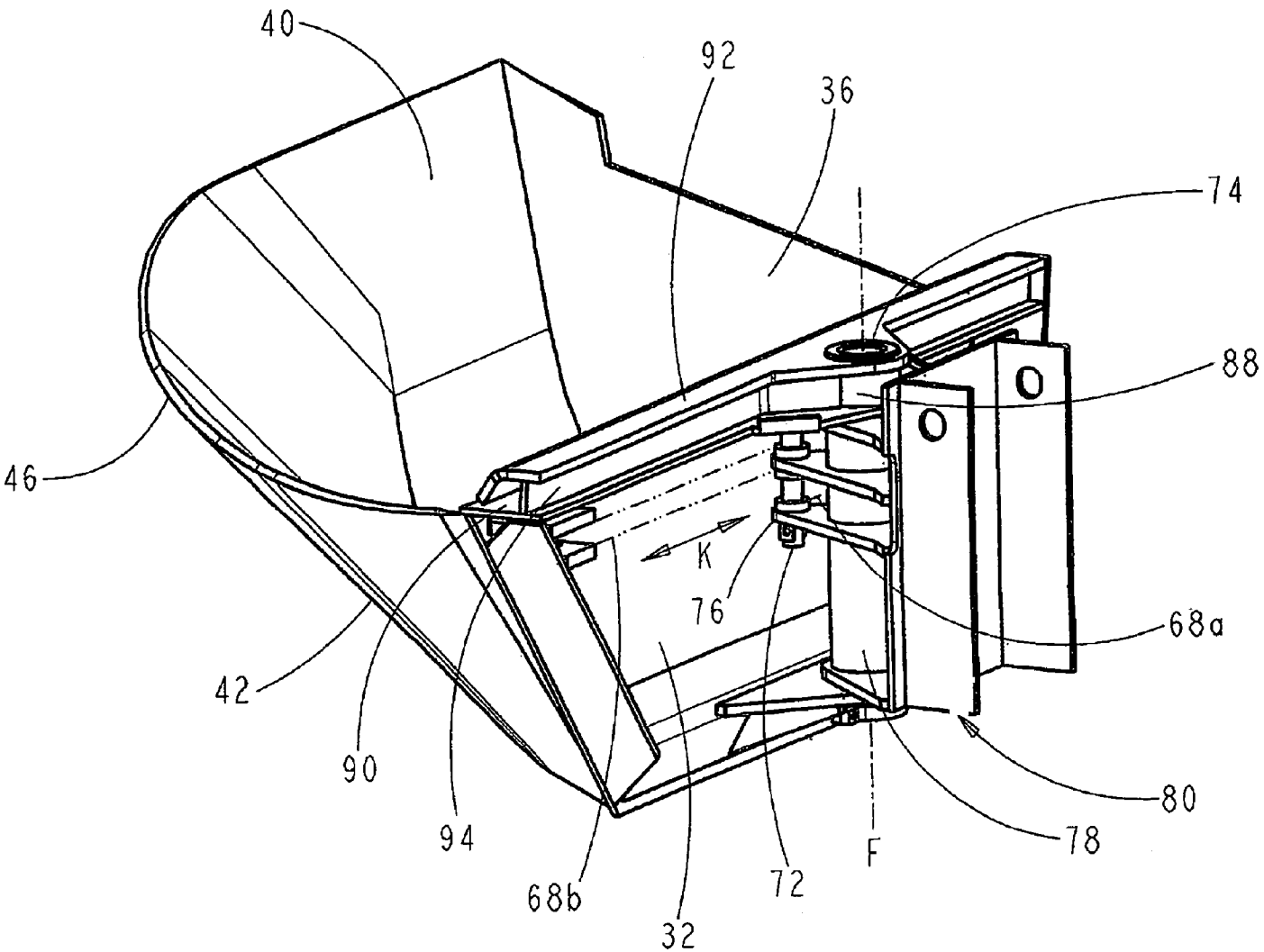
FIG. 14 is a front perspective view of the bucket of FIG. 4.

As seen in FIGS. 10-12, in operation, the driver of the excavator parks the excavator so that base 58 is parallel to roadway 60. The upper rotatable section 64 of the excavator is then rotated in direction H so as to rotate the boom, stick and bucket relative to the base by an angular offset sufficient to position bucket 30 vertically over the proposed ditch 66. With bucket 30 generally vertically over proposed ditch 66, the bucket may be rotated in direction E, that is direction E' about pivot axis F, so as to lower curved end wall 42 below side wall 36. Bucket 30 is then lowered in direction I so as to bring curved edge 46 and curved end wall 42 into engagement with the earth bordering shoulder 62. Curved end wall 42 is then dragged in a single pass in direction J so as to form proposed ditch 66. Once a volume of earth is scooped into bucket 30 over curved edge 46, the bucket is rotated about axis of rotation G so as to scoop the earth upwardly, and bucket 30 raised. As bucket 30 is raised, rotatable section 64 of the excavator may be rotated so as to position the bucket over a dump truck (not shown) parked on the roadway 60 so that the bucket may be unloaded by dropping its load of earth into the dump truck. With the bucket now empty, the cycle may be repeated to lengthen proposed ditch 66 along shoulder 62. As the length of proposed ditch 66 extends towards the excavator, the excavator is intermittently moved along shoulder 62 so that proposed ditch 66 may be dug in the span between bucket 30, when at the most fully extended articulated position of boom 56 and stick 54, and the closest distance of bucket 30 comes to the excavator cab when boom 56 and stick 54 are in their fully retracted position.

Because of the angular offset of boom 56, stick 54, and bucket 30 relative to base 58 of the excavator, the profile of curved end wall 42 including the profile of curved edge 46 as it is described above and illustrated herein, is such that, with bucket 30 rotated about axis F in direction E, the curved profile provides for a smoothly contoured ditch with no upper edge undercut on the embankment side of the ditch, normally all in a single pass of the bucket. The offset angle Δ between longitudinal axes C and D takes into account the physical limitations of how far bucket 30 may be rotated in direction E about axis F using conventional pivot couplers 52 referred to as tilting bucket mechanism or a "Wrist-A-Twist™". The cut back angle β of curved edge 46 relative to the forward edge 40*a* of bottom plate 40, in conjunction with the offset angular orientation of the bucket, stick and boom relative to the base 58 of the excavator, assists in curved end wall 42 biting downwardly into the ground as the bucket is dragged in direction J. This assists the curved end of the bucket staying in the ground rather than having to solely rely on the downward force applied by the excavator arm on the bucket. Similarly, the scoop angle p and the cut back angle π' assist in curved edge 46 and curved end wall 42 aggressively biting into the earth and urging the bucket to stay submerged in the earth as the bucket is translated in direction J. Thus up to a twelve foot offset is obtained between ditch line K (coincident with the buckets translation in direction J) and the longitudinal axis L of the excavator running parallel thereto. The shape of the curved end of the bucket (that is the cone), including the thirty-five degree angle of the radiused corner of the curved end, creates an offset effect whereby, once submerged in the soil, the bucket is urged to translate along the offset distance of ditch line K.

The pivoting of bucket 30 about pivot axis F is accomplished in one embodiment, not intended to be limiting, by the simultaneous actuation of hydraulic cylinders 68*a* and 68*b* (shown in dotted outline) mounted between ears 70*a* and 70*b* at their distal ends respectively, and at their inwardly opposed facing ends to shaft 72. Actuation of hydraulic cylinders 68*a* and 68*b* drives shaft 72 in direction K relative to top wall 32 of the bucket thereby rotating bucket 30 about axis F and tubular shaft 74. Shaft 72 is rotatably mounted to flanges 76, themselves rigidly mounted to tubular sleeve 78 and upper mounting bracket 80. Sleeve 78 is mounted to tubular shaft 74. Mounting bracket 80 is mounted to the distal end of stick 54 by means of a conventional excavator bucket coupler which provides for rotation of bucket 30 and coupler 52 about axis G. The rearmost end of tubular shaft 74 is rotatably mounted within a bearing housing 82, itself rigidly mounted onto top wall 32 by rigid plate 84 and its corresponding base 86. The forward-most end of tubular shaft 74 is rotatably mounted in collar 88, itself rigidly mounted to front plate 90. Rigid nose plate 92 is rigidly mounted so as to extend between collar 88, a forwardly extending rigid support flange 94, and front plate 90.

Figure 15:
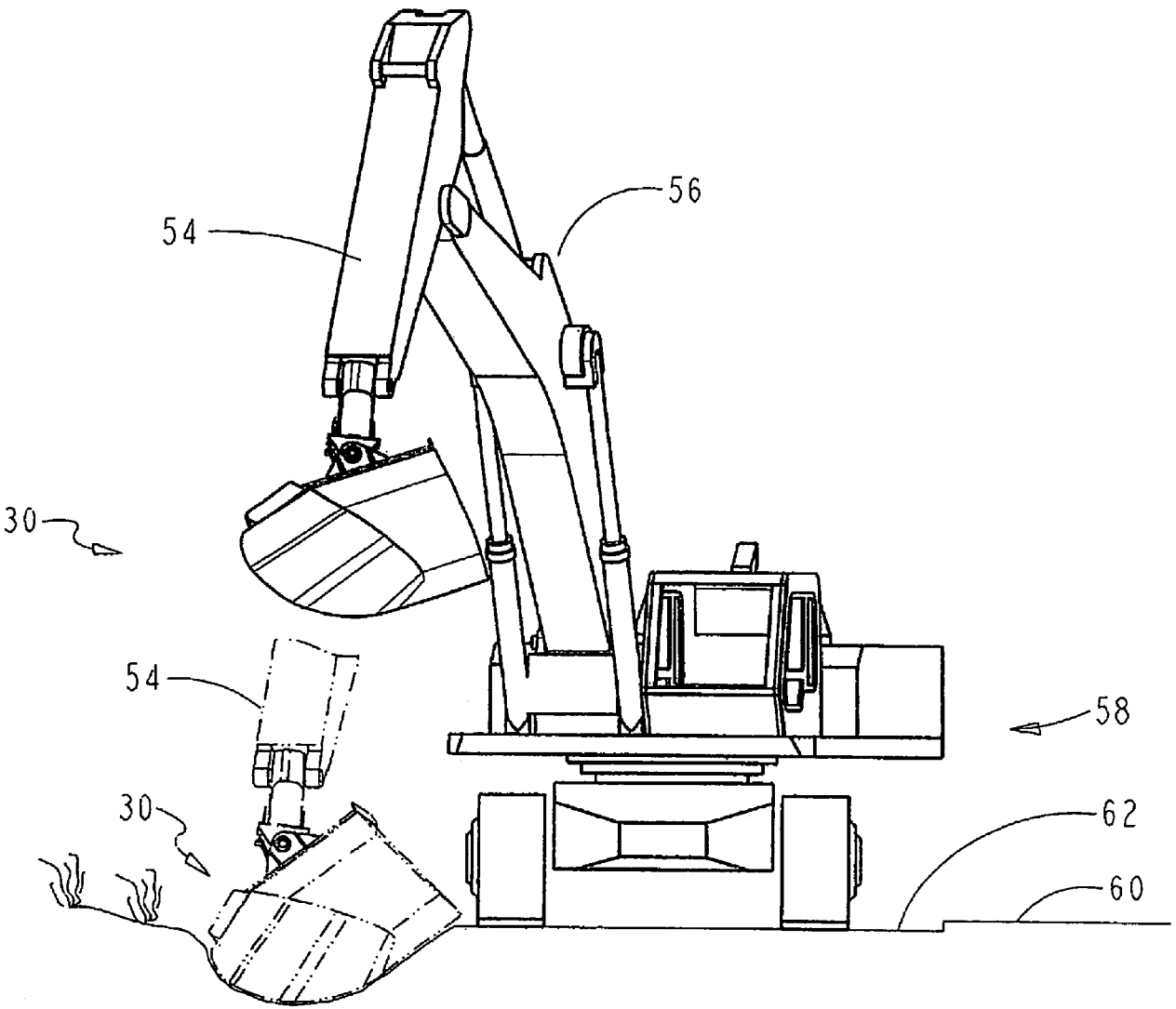
FIG. 15 is, in front elevation view, the bucket of FIG. 4 mounted on an excavator and oriented for excavation during forward translation of the excavator.

As seen in FIG. 15, in a method for use in lighter soil, the excavator excavates a ditch as it drives forwardly. This is accomplished by orienting the bucket forwardly relative to the excavator, again with the rounded end of the bucket disposed downwardly to engage the soil. The excavator then drives ahead, until the bucket is full and windrows start to form on either side of the bucket.

Figure 16:
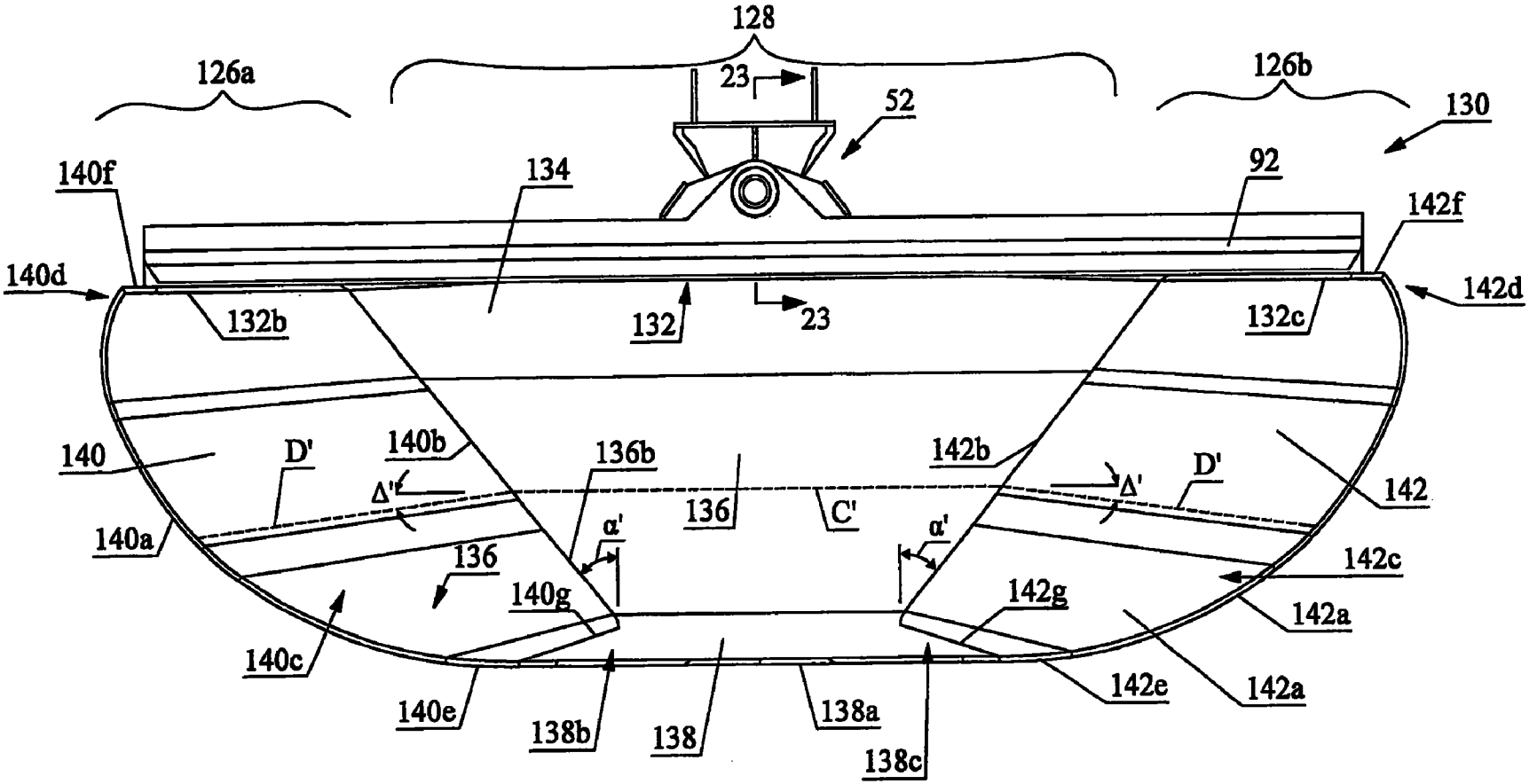
FIG. 16 is, in front elevation view, the ditch digging bucket according to another embodiment of the present invention.

As seen in FIG. 16, one-pass bucket 130 has a planar top wall 132, a planar rear wall 134, a curved lower wall 136, a generally planar bottom wall 138, and curved left and right end walls 140 and 142. Rear wall 134 is bounded by linear seams formed between rear wall 134 and top wall 132, left and right curved end walls 140 and 142, and lower wall 136 respectively. Rear wall 134 and lower wall 136 may also be formed of a unitary piece, and lower wall 136 and bottom wall 138 may also be formed of a unitary piece so long as in side elevation view they generally or substantially form the curvature of the bucket as illustrated by way of example in FIG. 18. Lower wall 136 is bounded by rear wall 134, left and right curved end walls 140 and 142, and bottom wall 138.

The rear edge 142*b* of right curved end wall 142 and the rear edge 140*b* of left curved end wall 140 are generally diagonally upwardly inclined when viewed in the front elevation of FIG. 16 and form an angle α' relative to the vertical. The right or front edge 142*a* of curved end wall 142, that is the edge opposite from left or rear edge 142*b*, forms, when viewed in front elevation, a complex curve which at its curved lower or bottom end 142*e* becomes tangent to bottom wall 138 where they intersect, and at its upper end 142*d* completes the scalloped or scooped lip of curved end wall 142 as it intersects non-tangentially for example generally orthogonally, with the top wall 132. Similarly, the front edge 140*a* of curved end wall 140, the edge opposite from rear edge 140*b*, forms a mirror image complex curve to that of curved end wall 142, so that its curved bottom end 142*e* also becomes tangent to bottom wall 138 where they intersect, and at its upper end 140*d* completes its scalloped or scooped lip. Curved end walls 140 and 142, although illustrated as each being formed of six contiguously seamed segments, are not intended to be so limited in its various embodiments. That is, curved end walls 140 and 142 may each be formed of one continuous curved sheet having no flat spots or may be segmented by a plurality of curved or planar plate segments welded together along their adjacent seams so as to form one contiguous generally curved sheet member having flat spots.

Figure 22:
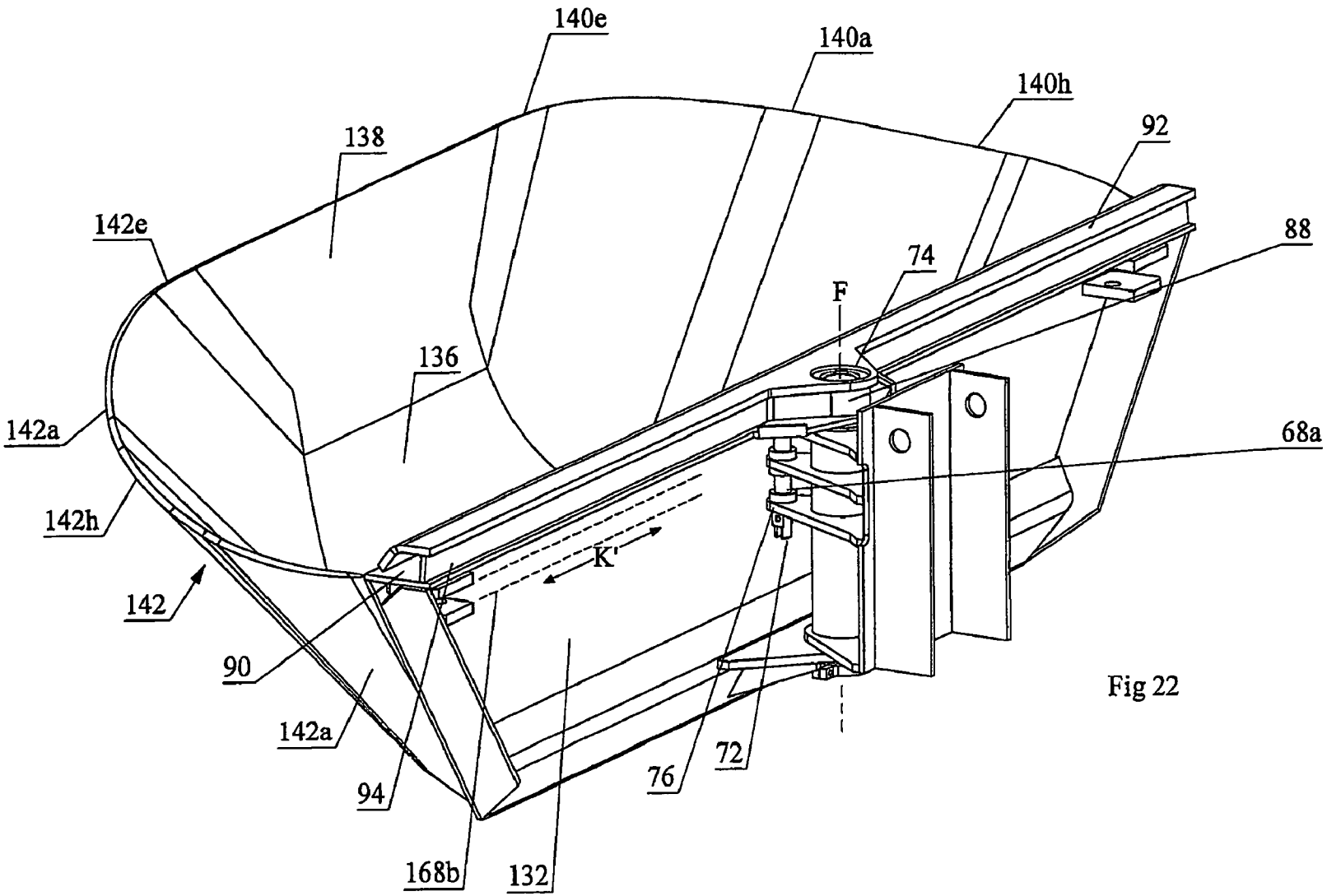
FIG. 22 is a front perspective view of the bucket of FIG. 16.
Figure 23:
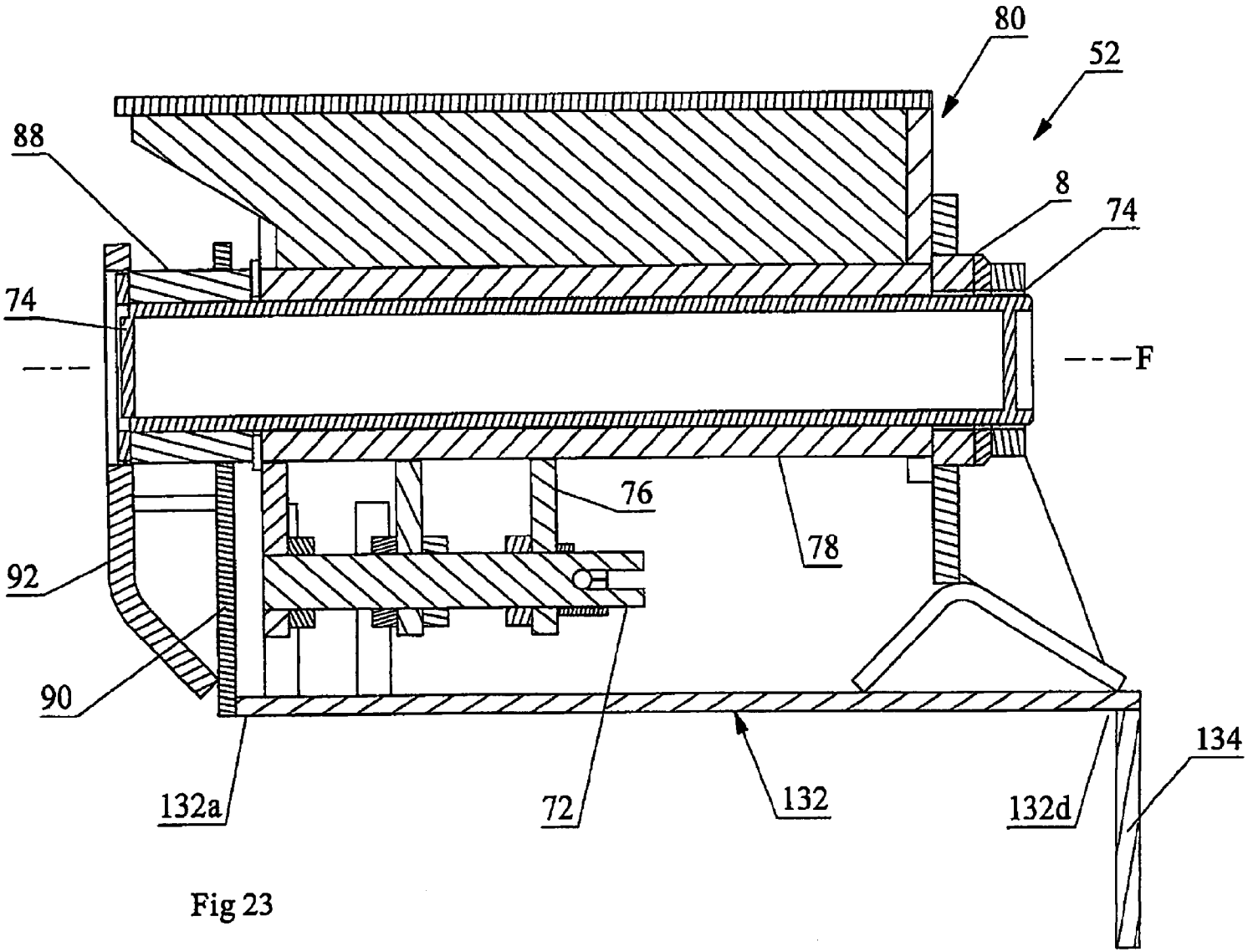
FIG. 23 is a cross-sectional view along line 23-23 in FIG. 16.
Figure 24:
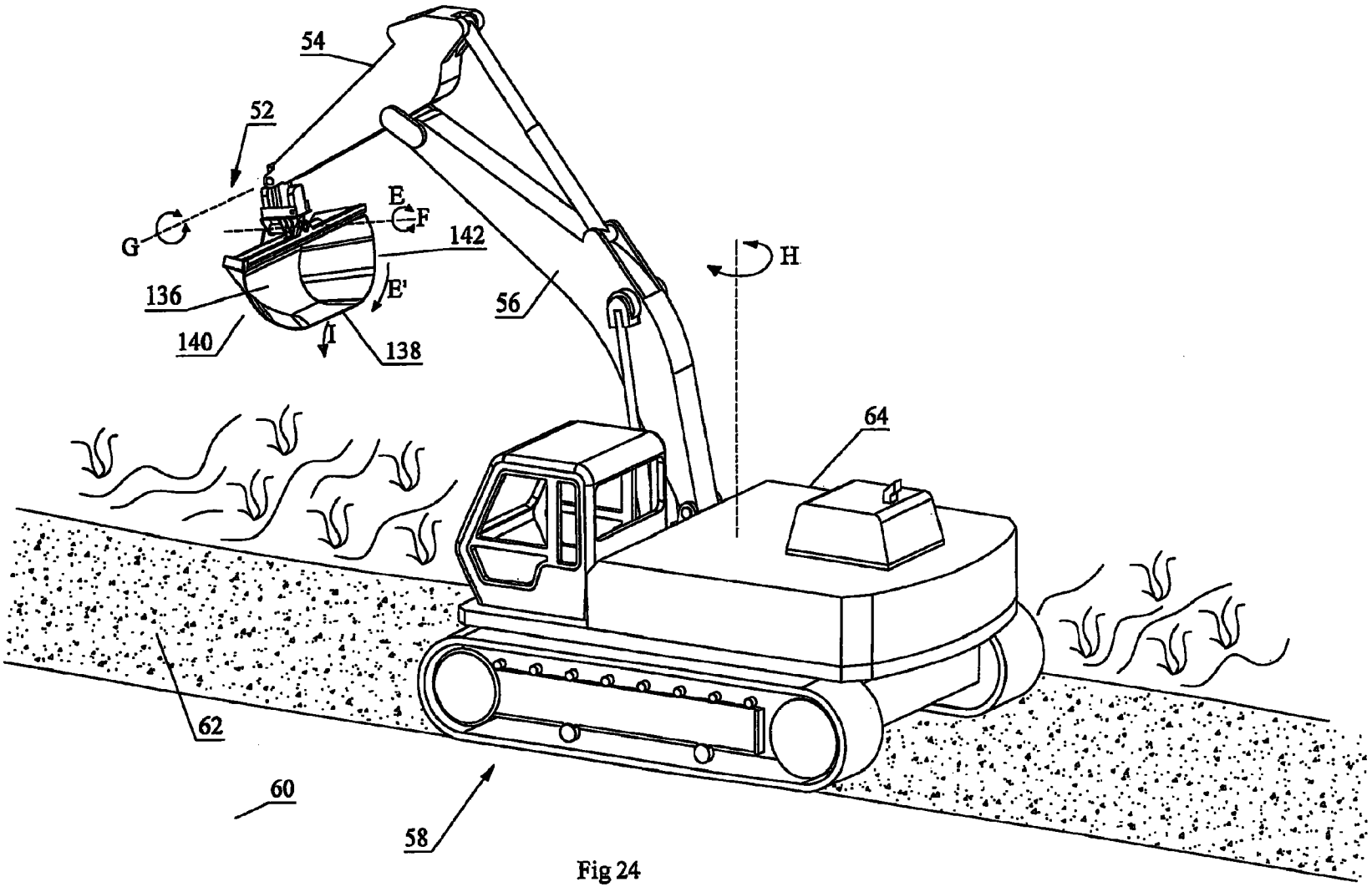
FIG. 24 is, in perspective view, the bucket of FIG. 16 mounted on an excavator.
Figure 25:
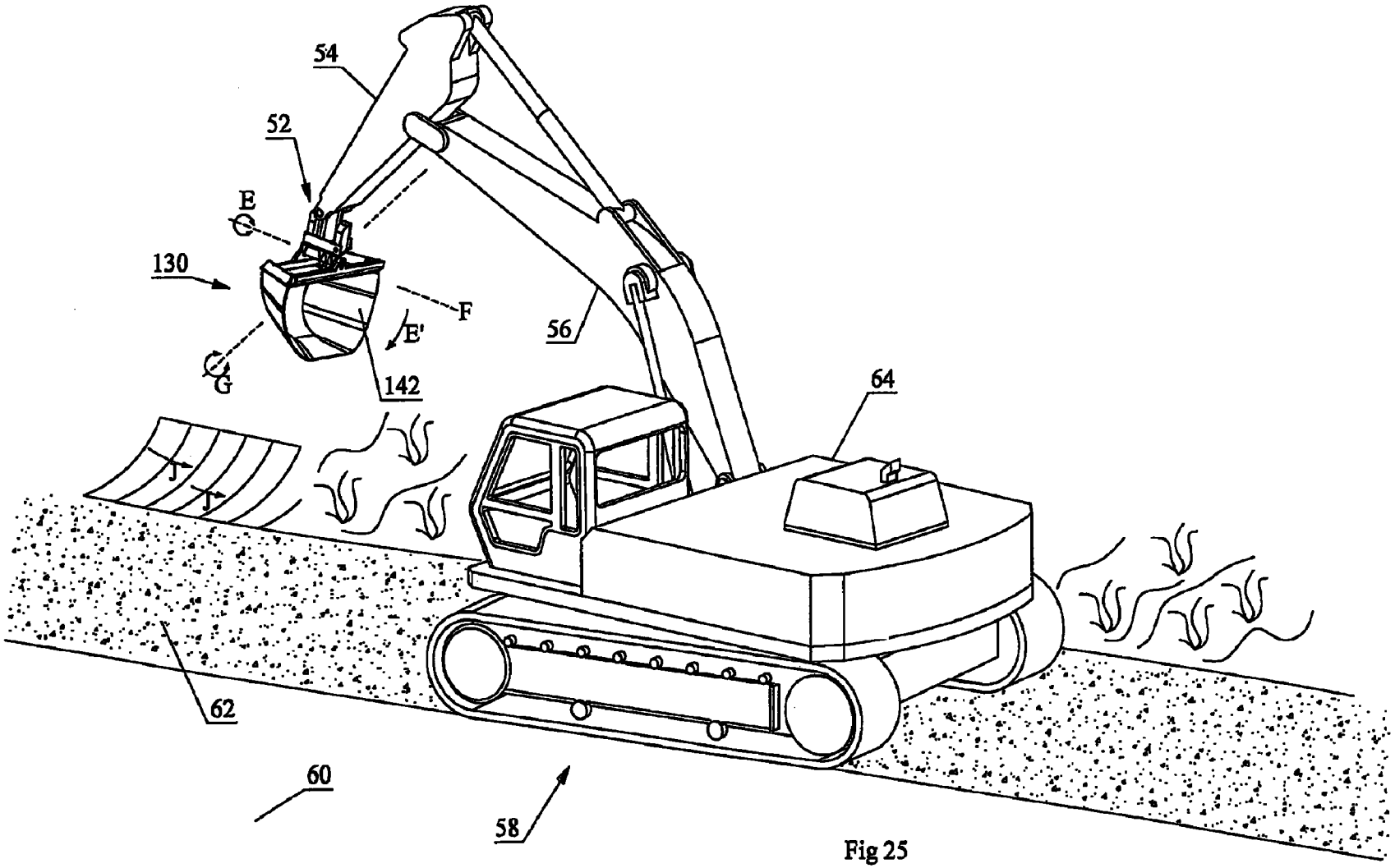
FIG. 25 is the view of FIG. 24, with the bucket lowered and ready to be dragged through the ground along a roadway shoulder so as to excavate a ditch.
Figure 26:
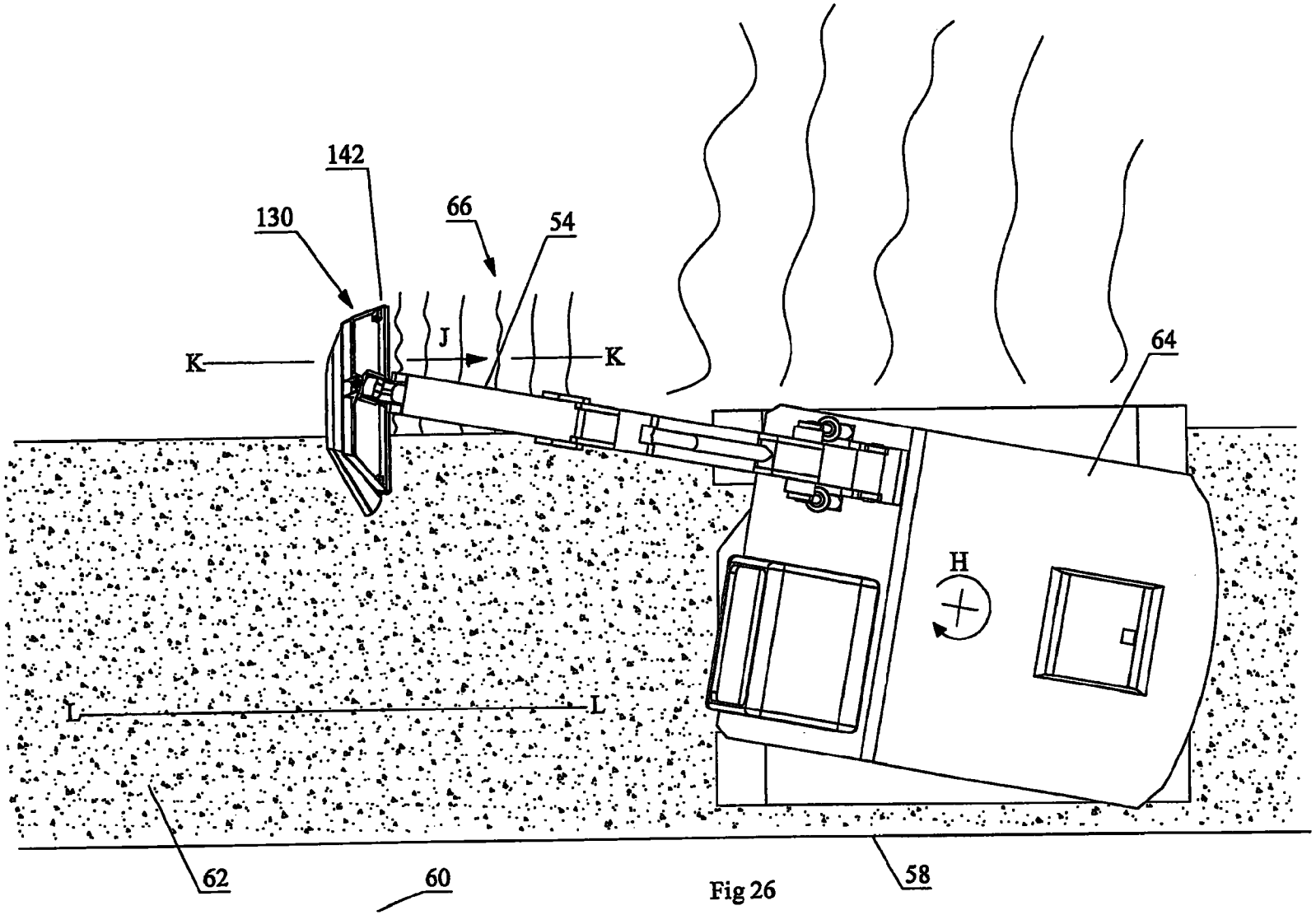
FIG. 26 is the excavator and bucket of FIG. 25, in plan view, with the excavator digging in front of the excavator.
Figure 27:
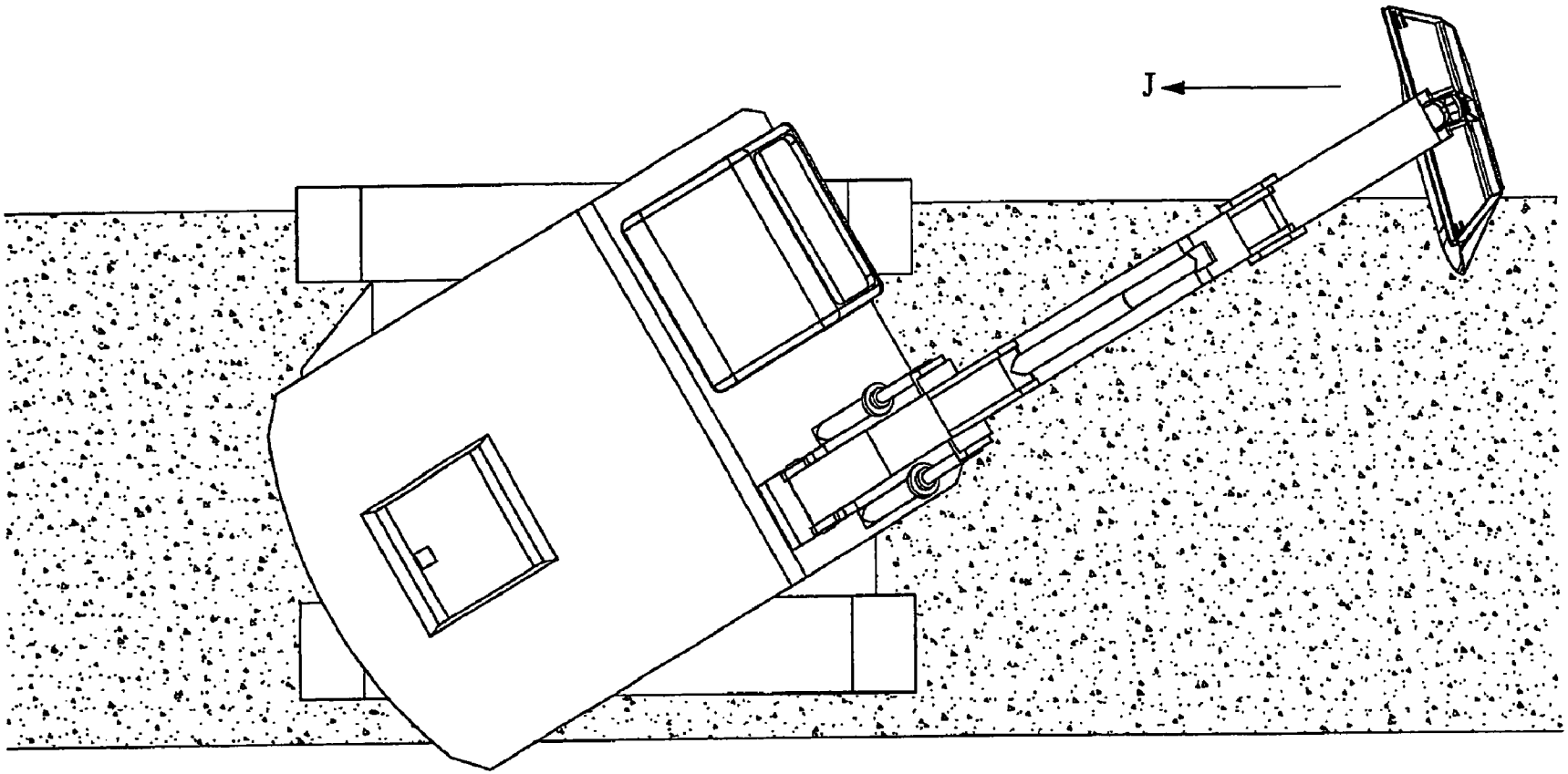
FIG. 27 is the excavator of FIG. 26 with the excavator cab and stick surveilled to dig to the rear of the excavator.

Top wall 132, rear wall 134, lower wall 136, bottom wall 138, may be characterized as forming a first bucket portion 128 having a longitudinal axis C' which extends parallel and generally equi-distant between top wall 132 and bottom wall 138. Curved end walls 140 and 142 may be characterized as forming second bucket portions 126*a* and 126*b* each having a longitudinal axis D' which extends perpendicularly, when viewed in front elevation, from rear edges 140*b* and 142*b* at the intersection with longitudinal axis C' so as to form the angle Δ' therebetween and so as to extend generally parallel between the upper and lower edges 142*f* and 142*g* respectively of curved end wall 142 and generally parallel between the upper and lower edges 140*f* and 140*g* respectively of curved end wall 140. As may be seen perhaps best in FIG. 16, longitudinal axes C' and D' of, respectively, the first and second portions of bucket 130 so defined are not collinear respectively, but rather, the second portions 126*a* and 126*b* of the bucket formed by curved end walls 140 and 142 each form a shovel or scoop having a principle axis declined or diverging or otherwise dropped downwardly relative to the first portion 128 of the bucket. Thus, with a bucket coupler 52 such as Twist-A-Wrist™ pivotable coupler mounted to the distal end of an excavator stick 54 as better seen in FIGS. 22-24, bucket 130 may be rotated in direction E about the pivot axis F of coupler 52 so as to rotate either curved end wall 140 or 142 downwardly relative to stick 54 while simultaneously rotating the first portion 128 of the bucket upwardly. Thus rotation about axis F forms a first degree of freedom for rotational movement of bucket 130. Of course, a second degree of freedom is provided by the conventional scooping motion of the bucket toward the cab of the excavator about axis G. Other degrees of freedom of motion are provided by the extension and retraction and swiveling of stick 54 and boom 56 relative to the base 58 of the excavator and by translation of the excavator on its tracks forwardly or rearwardly as for example parallel to roadway 60 while translating the excavator along shoulder 62.

Figure 17:
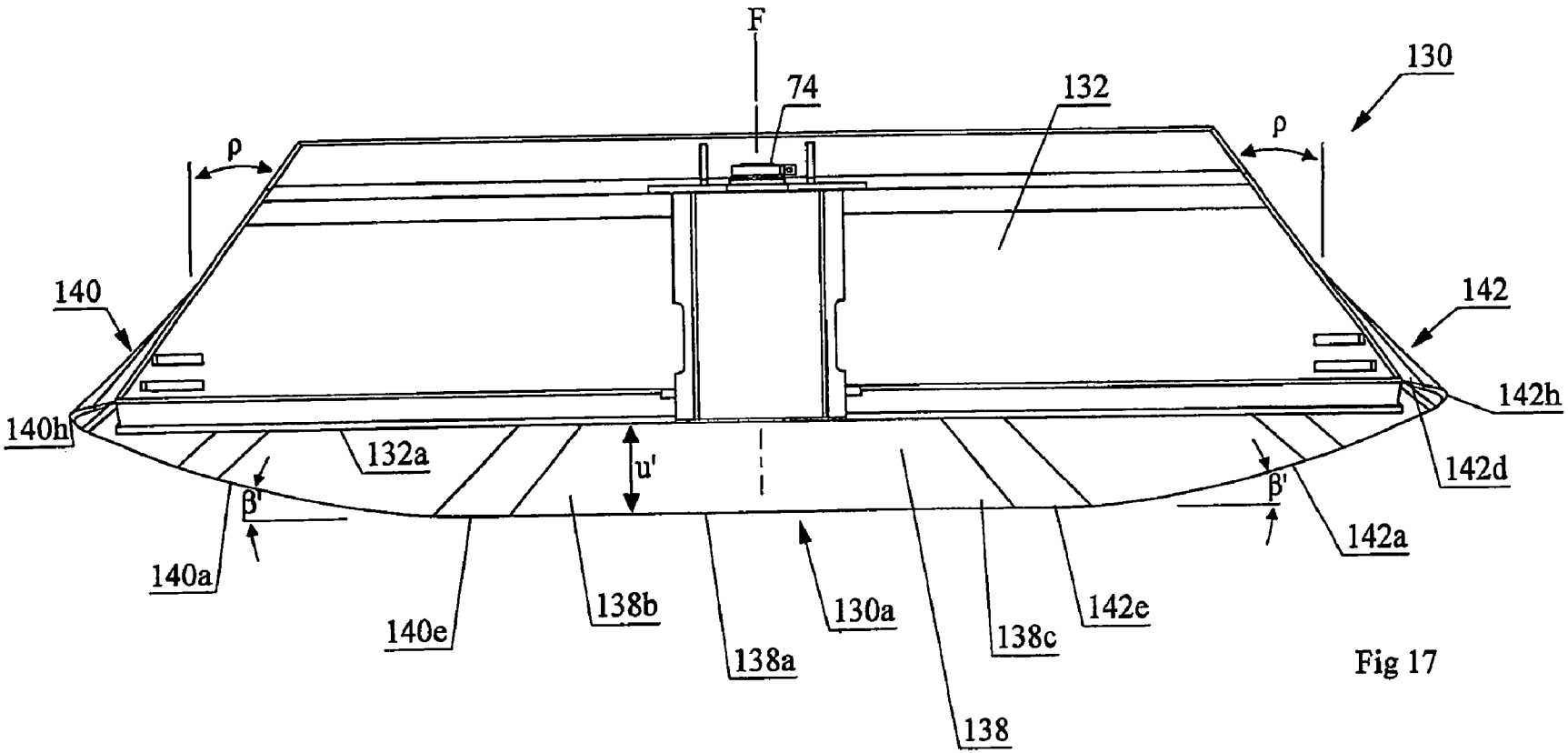
FIG. 17 is, in plan view, the bucket of FIG. 16.
Figure 18:
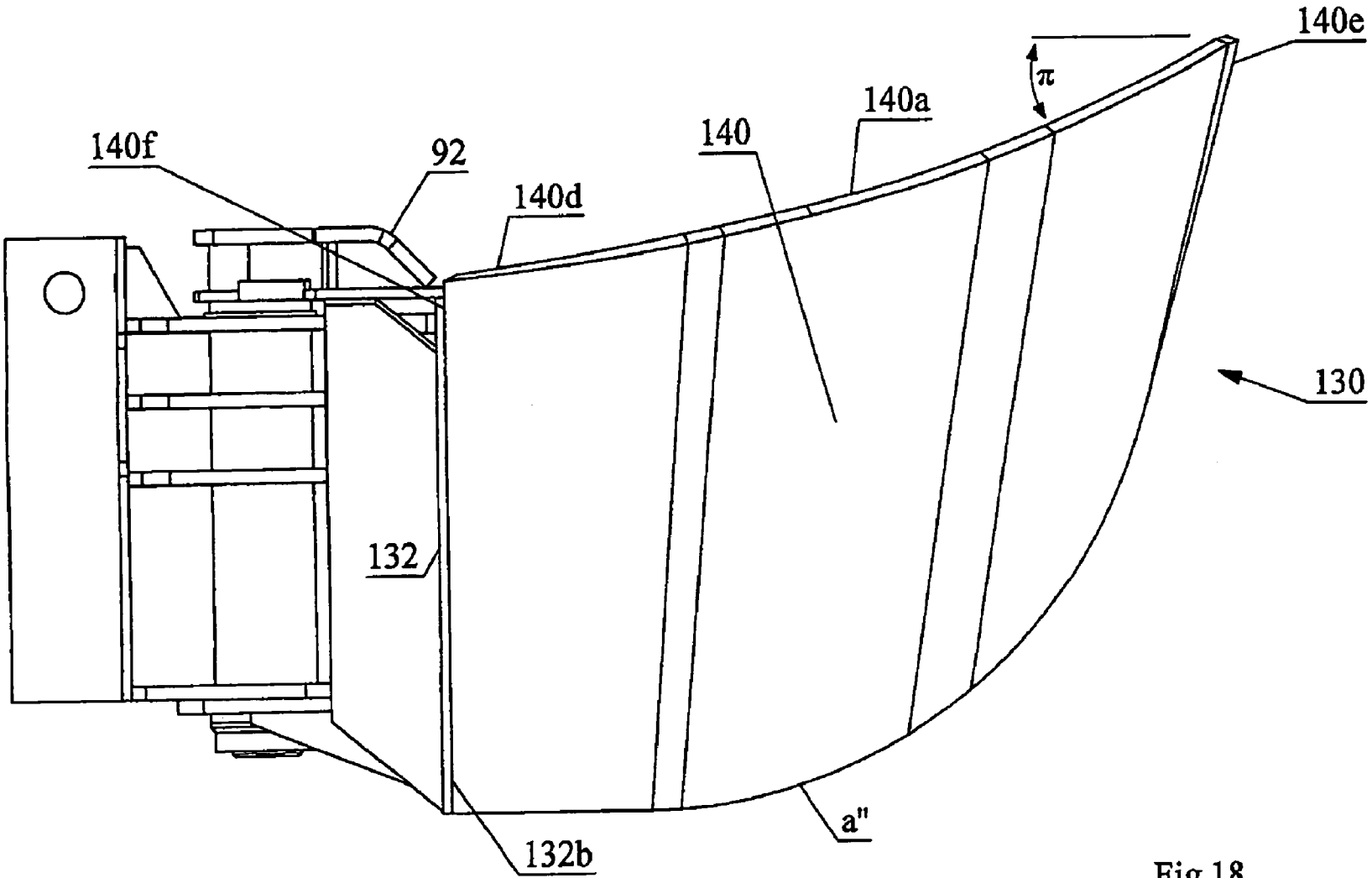
FIG. 18 is, in left side elevation view, the bucket of FIG. 16.
Figure 19:
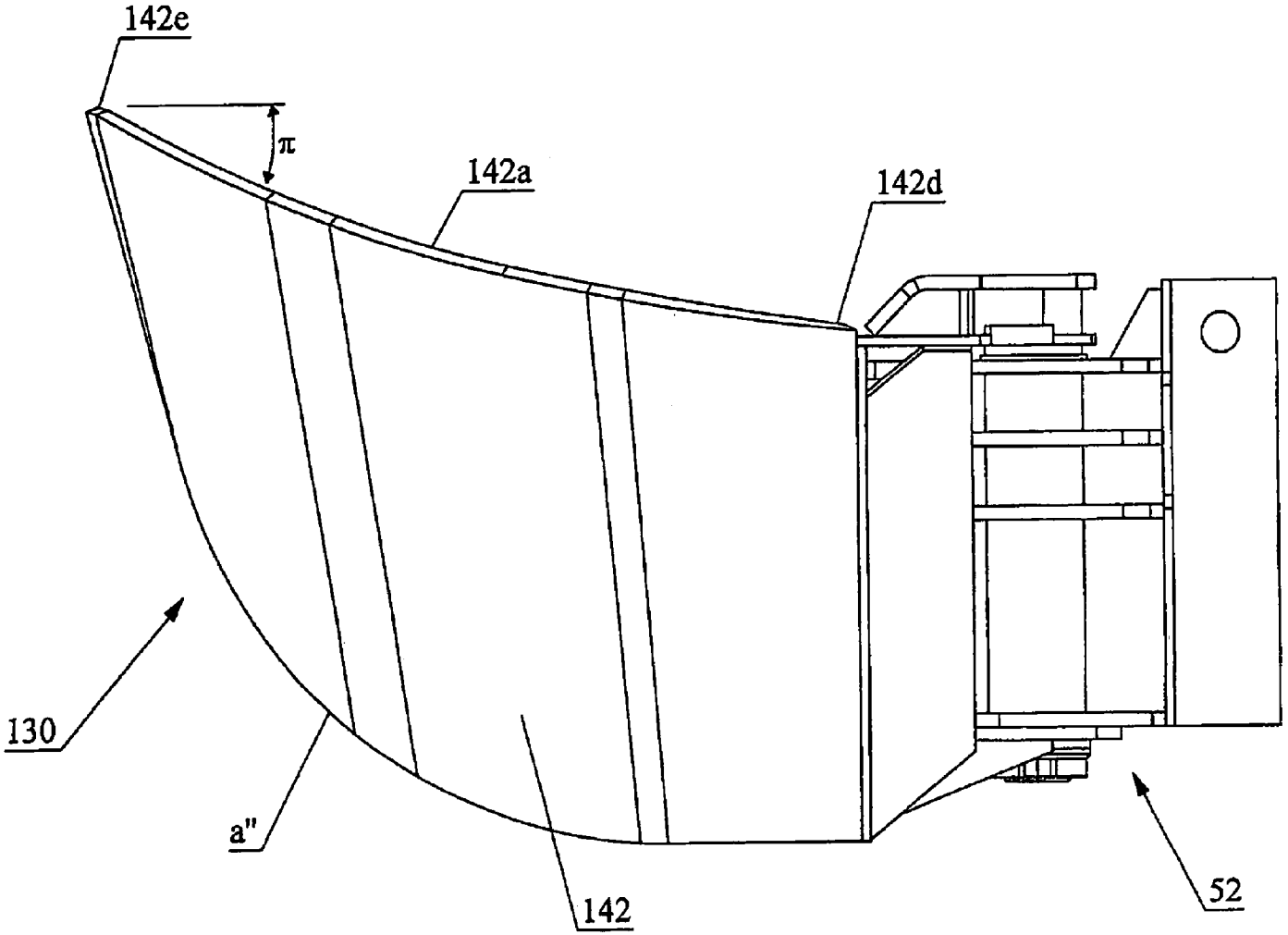
FIG. 19 is, in right side elevation view, the bucket of FIG. 16.
Figure 20:
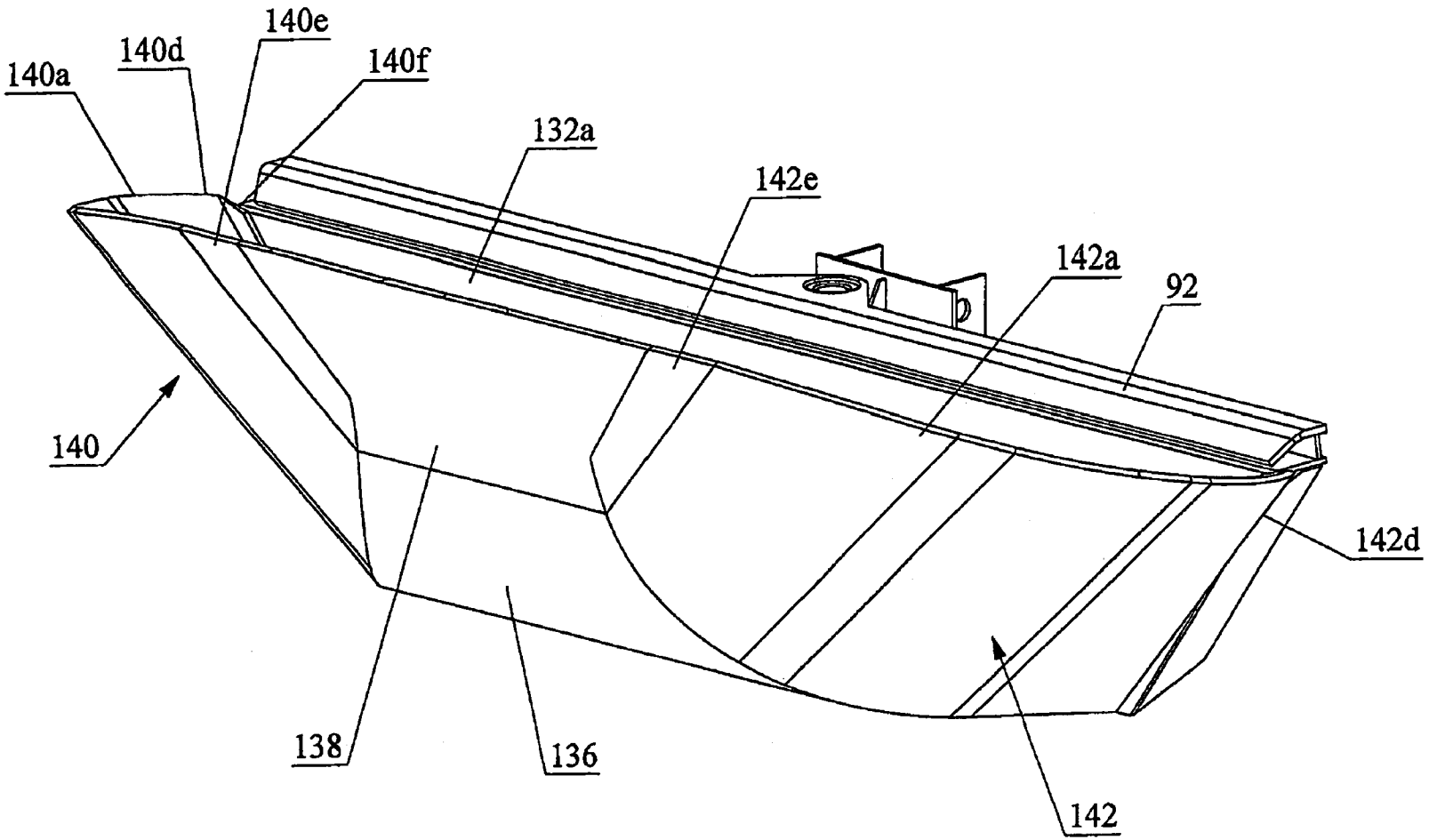
FIG. 20 is, in right side perspective view, the bucket of FIG. 16.
Figure 21:
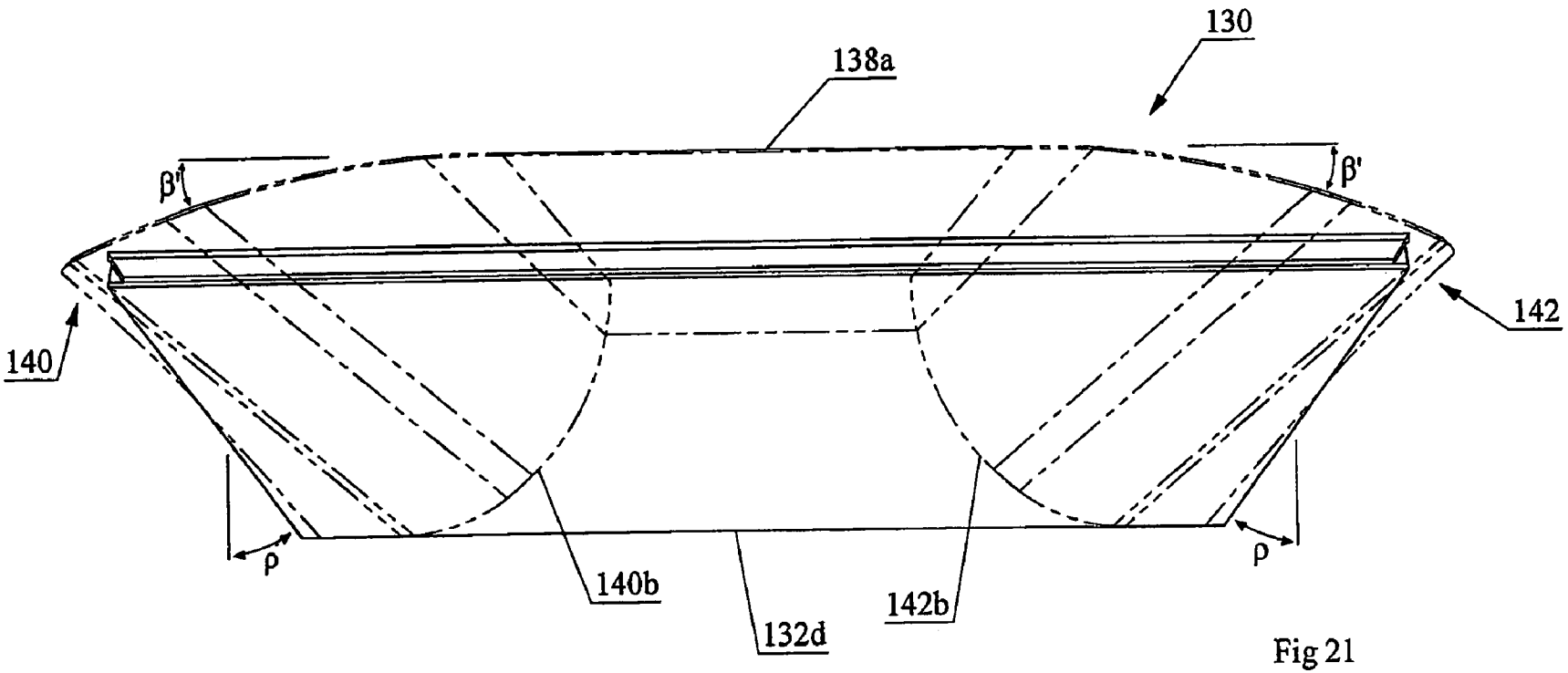
FIG. 21 is, in bottom view, the bucket of FIG. 16 showing the top plate in solid outline and the remainder of the bucket in dotted outline.

As seen in FIG. 17, the left and right curved front edges 140*a* and 142*a* also form angle β', when viewed in plan view, with a line extending linearly from front edge 138*a* of bottom wall 138. Also, when viewed in left side elevation, as seen in FIG. 18, curved edges 140*a* and 142*a* generally form an angle π with the horizontal, which angle varies because of the slight curvature in that view of curved edge 140*a*, but which generally is twenty-three degrees. Similarly, front edge 140*a* of curved end wall 140 forms an angle π with the horizontal.

Figure 16A:
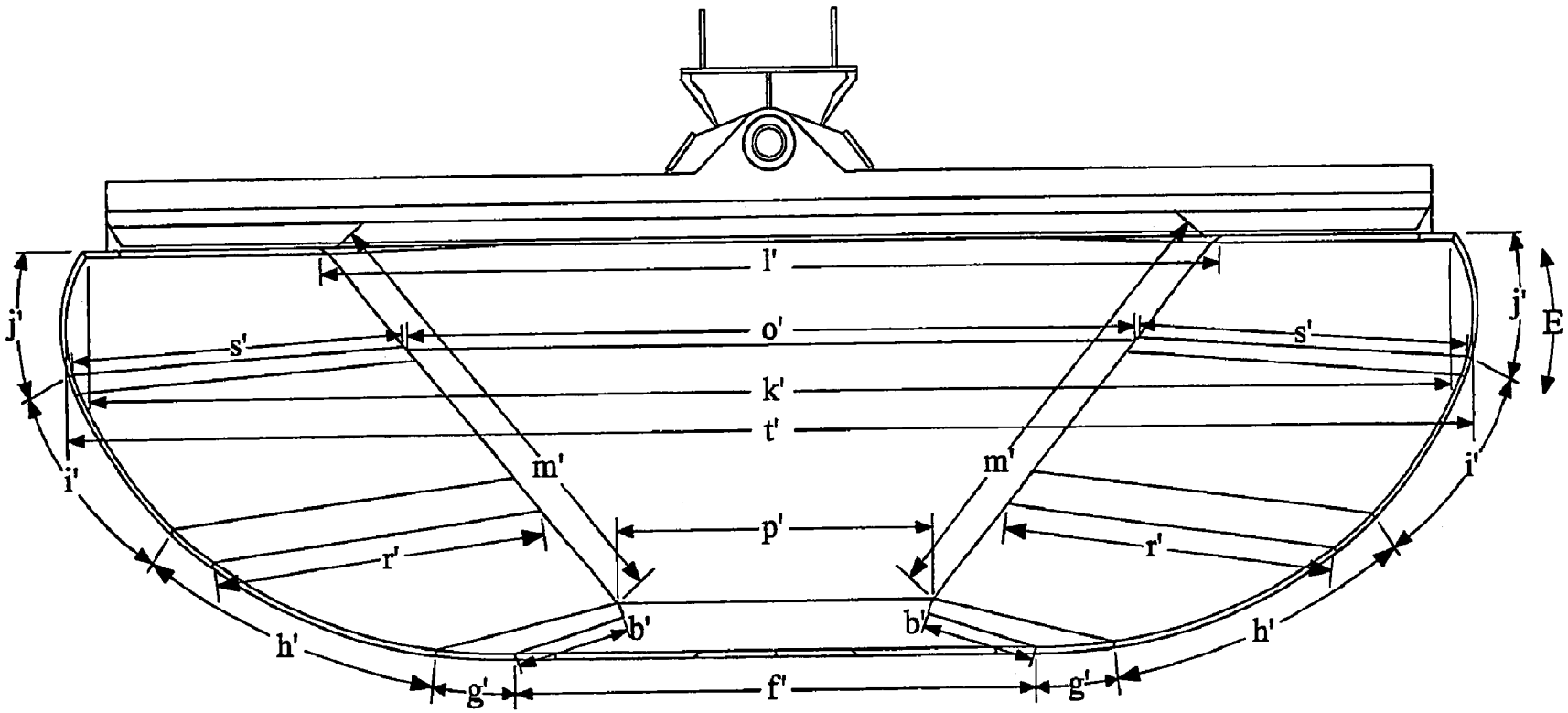
FIG. 16*a* is the view of FIG. 16 with dimension lines added.

What follows are dimensions representative of a preferred embodiment which, although not intending to be limiting, will provide to those skilled in the art guidelines representative of the scaleable proportions of the various parts of the bucket. Thus as seen in FIG. 18, dimension a", which is the curved profile when viewed in left side elevation of the back and bottom of the bucket, may be fifty inches. The depth of the bucket illustrated as dimension b' in FIG. 16*a* may be twenty-nine inches. Dimension ff' which extends along the front edge 138*a* of bottom wall 138, may be approximately sixty inches. Dimension g', the length of the front edge of lower ends 140*e* and 142*e* of curved end walls 140 and 142, may be nine inches. An adjacent segment of curved edges 140*a* and 142*a*, each indicated by dimension h', may be nineteen inches. The adjacent segment of curved edges 140*a* and 142*a*, each indicated by dimension i', may be twenty-nine inches. Finally, the adjacent segment of curved edges 140*a* and 142*a* including upper ends 140*d* and 142*d*, each indicated by dimension j', may be fourteen inches. The total length of top wall 142, including the right edge protrusions 140*f* and 142*g*, as indicated by dimension k' may be approximately one hundred fifty-five inches.

Inside the bucket itself, dimension l' may be approximately one hundred inches (the dimension between curved end walls 140 and 142 along top wall 132), dimension m' may be forty inches (the length of rear edges 140*b* and 142 measured so as to follow the curvature of the rear of the bucket), angle Δ' may be in the order of twenty-seven degrees (although other angles formed between axes C' and D' or example within the range of twenty to thirty-five degrees depending on the available range of angular rotation about axis F, fall within the scope of the present invention), dimension n' seen in FIG. 18 may be thirty-four and one half inches (the height of the open front face of the bucket), dimension o' may be approximately ninety-three inches (the length of seam 134*a* between rear wall 134 and lower wall 136 as that seam extends between the intersection with rear edges 140*b* and 142*b*), and dimension p' may be approximately thirty-six inches (the length of seam 138*a* between lower wall 136 and bottom wall 138 as it extends from the intersection with rear edges 140*b* and 142*b*). Within the curved end portions of the bucket 130, the length dimensions extending from the rear edges 140*b* and 142*b* to front edges 140*a* and 142*a* are illustrated as adjacent dimension lines q' which may be twenty-four and one half inches, r' which may be thirty-three and one half inches, and s' which may be forty inches. Dimension t' indicates the length of bucket 130 at its greatest when viewed in front elevation. Dimension t' may be approximately one hundred-sixty inches. Angle α' may be approximately twenty-seven degrees, and angle θ' may be about five degrees. Angle ρ may be thirty-five degrees.

As seen in FIGS. 24-28, in operation, the driver of the excavator parks the excavator so that base 58 is parallel to roadway 60. The upper rotatable section 64 of the excavator is then rotated in direction H so as to rotate the boom, stick and bucket relative to the base by an angular offset sufficient to position bucket 30 vertically over the proposed ditch 66 to the front or rear or the excavator. With bucket 130 generally vertically over proposed ditch 66, the bucket may be rotated in direction E, for example direction E' about pivot axis F, so as to lower one of the curved end walls 140 or 142 below the opposite curved end wall. Bucket 130 is then lowered in direction I so as to bring the curved front edge and curved end wall into engagement with the earth bordering shoulder 62. The curved end wall is then dragged in a single pass in direction J so as to form proposed ditch 66. Once a volume of earth is scooped into bucket 130 over the curved front edge, the bucket is rotated about axis of rotation G so as to scoop the earth upwardly, and bucket 130 raised. As bucket 130 is raised, rotatable section 64 of the excavator may be rotated so as to position the bucket over a dump truck (not shown) parked on the roadway 60 so that the bucket may be unloaded by dropping its load of earth into the dump truck. With the bucket now empty, the cycle may be repeated to lengthen proposed ditch 66 along shoulder 62. As the length of proposed ditch 66 extends towards the excavator, the excavator is intermittently moved along shoulder 62 so that proposed ditch 66 may be dug in the span, both forwardly and rearwardly of the excavator, between bucket 130, when at the most fully extended articulated position of boom 56 and stick 54, and the closest distance of bucket 130 comes to the excavator cab when boom 56 and stick 54 are in their fully retracted position.

Because of the angular offset of boom 56, stick 54, and bucket 130 relative to base 58 of the excavator, the profile of the curved end walls including the profile of curved front edges as they are described above and illustrated herein, is such that, with bucket 130 rotated about axis F in direction E, each curved profile on each curved end provides for a smoothly contoured ditch with no upper edge undercut on the embankment side of the ditch, normally all in a single pass of the bucket. The offset angle Δ' between longitudinal axes C' and D' takes into account the physical limitations of how far bucket 130 may be rotated in direction E about axis F using conventional pivot couplers 52 referred to as tilting bucket mechanism or a "Wrist-A-Twist™". The cut back angle β' of the curved front edge relative to the forward edge 138*a* of bottom plate 138, in conjunction with the offset angular orientation of the bucket, stick and boom relative to the base 58 of the excavator, assists in the curved end wall 140 or 142 biting downwardly into the ground as the bucket is dragged in direction J. This assists the curved end of the bucket staying in the ground rather than having to solely rely on the downward force applied by the excavator arm on the bucket. Similarly, the scoop angle ρ and the cut back angle π assist in the curved front edges 140*a* and 142*a* and curved end walls 140 and 142 aggressively biting into the earth and urging bucket 130 to stay submerged in the earth as the bucket is translated in direction J. Thus up to a twelve foot offset is obtained between ditch line K (coincident with the buckets translation in direction J) and the longitudinal axis L of the excavator running parallel thereto. The shape of the curved end of the bucket (that is the cone), including the thirty-five degree angle of the radiused corner of the curved end, creates an offset effect whereby, once submerged in the soil, the bucket is urged to translate along the offset distance of ditch line K. Because bucket 130 has two rounded ends, the bucket may be translated along a first length of ditch line K, such as illustrated, and then the cab rotated to the opposite direction and the bucket may be translated along a second length of ditch line K which extends oppositely from the first length of ditch line K, that is, to the rear of the excavator. Thus with the use of a double-ended bucket, the length of ditch line K that may be excavated without moving the excavator is doubled as compared to the use of the single ended bucket 30.

The pivoting of bucket 130 about pivot axis F is accomplished in one embodiment, not intended to be limiting, by the simultaneous actuation of hydraulic cylinders 68*a* and 68*b* (shown in dotted outline) mounted between ears 70*a* and 70*b* at their distal ends respectively, and at their inwardly opposed facing ends to shaft 72. Actuation of hydraulic cylinders 68*a* and 68*b* drives shaft 72 in direction K relative to top wall 132 of the bucket thereby rotating bucket 130 about axis F and tubular shaft 74. As before, shaft 72 is rotatably mounted to flanges 76, themselves rigidly mounted to tubular sleeve 78 and upper mounting bracket 80. Sleeve 78 is mounted to tubular shaft 74. Mounting bracket 80 is mounted to the distal end of stick 54 by means of a conventional excavator bucket coupler which provides for rotation of bucket 130 and coupler 52 about axis G. The rearmost end of tubular shaft 74 is rotatably mounted within a bearing housing 82, itself rigidly mounted onto top wall 132 by rigid plate 84 and its corresponding base 86. The forward-most end of tubular shaft 74 is rotatably mounted in collar 88, itself rigidly mounted to front plate 90. Rigid nose plate 92 is rigidly mounted so as to extend between collar 88, a forwardly extending rigid support flange 94, and front plate 90.

Figure 28:
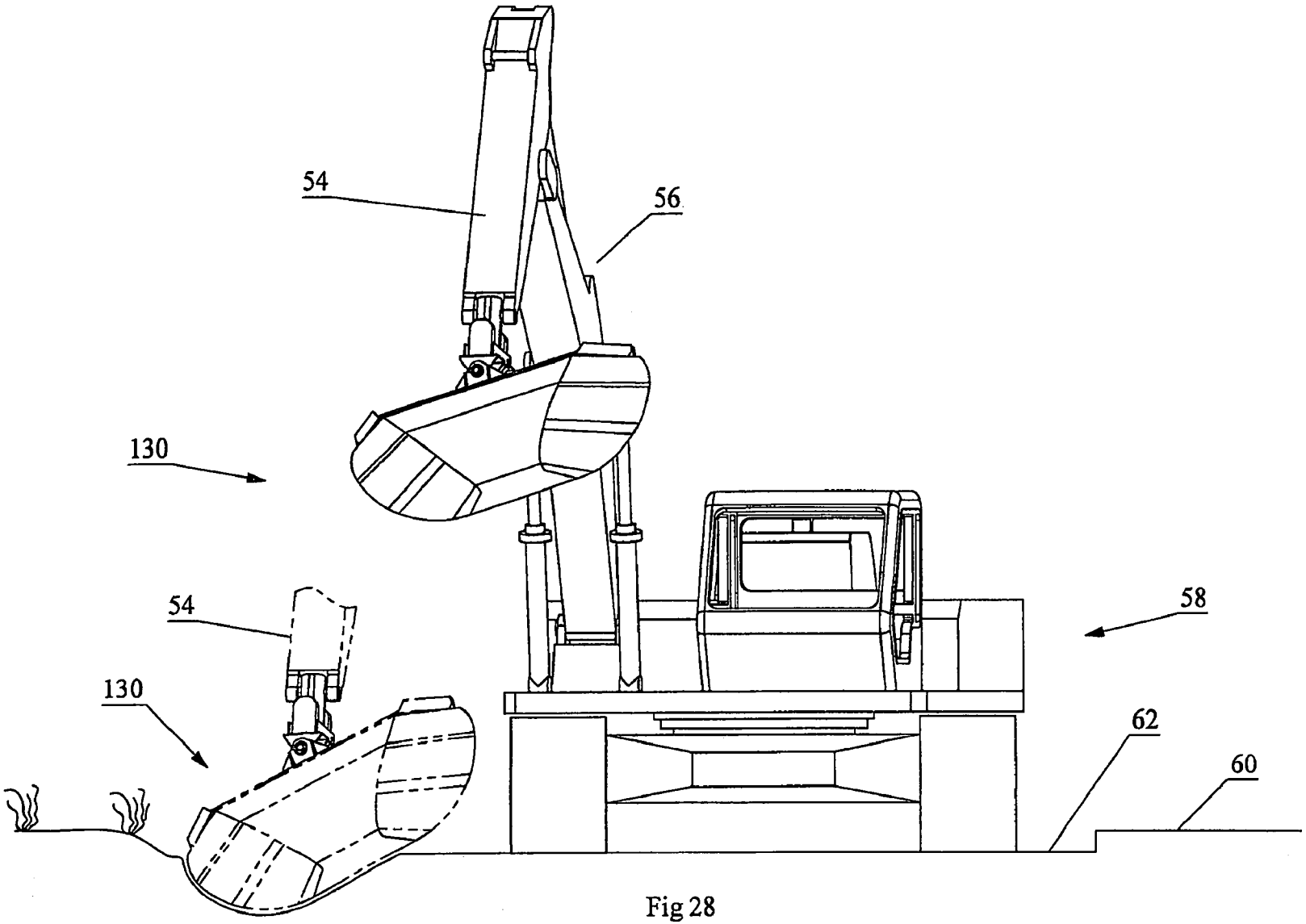
FIG. 28 is, in front elevation view, the bucket of FIG. 16 mounted on an excavator and oriented for excavation during forward translation of the excavator.

As seen in FIG. 28, in a method for use in lighter soil, the excavator excavates a ditch as it drives forwardly or rearwardly. This is accomplished by orienting the bucket so that its opening faces away from the stick, ie forwardly relative to the excavator as the excavator is driven forwardly, with a first rounded end of the bucket disposed downwardly to engage the soil. The excavator may be driven rearwardly also with the bucket facing rearwardly and the second rounded end of the bucket inclined downwardly into the soil. The excavator then drives forwardly or rearwardly, until the bucket is full and windrows start to form on either side of the bucket.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A one-pass bucket (130) for use on the end of an actuable arm on a mechanical ditch digging apparatus for digging a ditch in earth parallel to a roadway, the bucket comprising a top wall (132); a bottom wall (138); a rear wall (134, 136) integral with said bottom wall, said rear wall and said bottom wall defining a curve (a") extending downwardly and forwardly from a rear edge (132*d*) of said top wall to an open front end of said bucket; a left side curved end wall (140) extending forwardly from a rear edge (140*b*) of said curved end wall (140) and interconnecting a left end of said top wall (132*b*) and a corresponding left end (138*b*) of said bottom wall (138), a coupler mounted on said top wall for coupling said bucket to the arm of the digging apparatus; and, a curved end wall (142) opposite said left side wall (140), said right side curved end wall (142) extending forwardly from a rear edge 142*b* thereof opposite said rear edge (140*b*), and interconnecting an opposite right end (132*c*) of said top wall, opposite said left end (132*b*) of said top wall (132), and an opposite right end (138*c*) of said bottom wall (138), said right side curved end wall (142) having opposite curved bottom (142*e*) and top (142*d*) ends, said left and right side curved end walls (140, 142) diverging forwardly from said rear wall (134); said top wall (132), said bottom wall (138) and said left and right side curved end walls (140, 142) having forward edges (132*a*, 138*a*, 140*a*, 142*a*) defining said open front end (130*a*) of said bucket (130) for receiving earth; each of said left and right side curved end walls defining a convexity (140*c*, 142*c*) extending tangentially from, respectively, said left end (138*b*) and said right end (138*c*) of the bottom wall (138), each convexity (140*c*, 142*c*) tapering rearwardly toward said rear wall (134, 136), and, when viewed in front elevation, said curved end walls (140, 142) extending convexly at said bucket opening (130*a*), from said bottom wall (138) to said top wall (132), and extending substantially diagonally upwardly therefrom at said rear edges (140*b*, 142*b*) of said curved end walls so that said forward edges (140*a*, 142*a*) of said curved end walls (140, 142) curve upwardly towards a plane containing said top wall (132) so as to intersect said top wall (132) non-tangentially, and said rear edges (140*b*, 142*b*) extend diagonally to intersect said plane of said top wall (132), whereby a round bottom ditch may be formed by rotating one of said curved end walls (140, 142) downwardly relative to said coupler (52) coupling said bucket (130) to the actuable arm of the ditch digging apparatus; and dragging said one of said curved end walls (140, 142) through the earth longitudinally along a proposed ditch (66) in a single pass, wherein, when said front opening (130*a*) of the bucket (130) is viewed in front elevation, said bottom wall (138), said rear wall (134, 136), and said left end of said top wall (132*b*) define a central portion (128) of said bucket having a central longitudinal axis (C') substantially parallel to and substantially equi-distant between said top and bottom walls (132, 138); and, said left and right curved end walls (140, 142), and said left and right ends (132*b*, 132*c*) of said top wall (132) define, respectively, left and right portions (126*a*, 126*b*) of said bucket (130), each said left and right portion having a longitudinal axis (D') wherein said two longitudinal axes D' form an oppositely disposed pair of end longitudinal axes, and wherein said central longitudinal axis (C') and said pair of end longitudinal axes (D') intersect substantially on corresponding said rear edges (140*b*, 142*b*) of their respective said curved end wall (140, 142), and wherein said pair of end longitudinal axis (D') diverge downwardly from colinearity with said central longitudinal axis (C'), and wherein said curved end walls (140, 142) have, respectively, left and right curved bottom ends (140*e*, 142*e*) which intersect said bottom wall (138) each approximately one third of the distance (f/k') along a length (k') corresponding the length of said top wall (132), and wherein, when said bucket is viewed in plan view, said curved end walls (140,142) diverge forwardly (angle p) from said rear wall (134) and said forward edge (138*a*) of said bottom wall (138) and said curved bottom ends (140*e*, 142*e*) of said curved end walls (140, 142) extend forwardly of said forward edge (132*a*) of said top wall (132), and said forward edges (140*a*, 142*a*) of said curved end walls (140, 142) slope rearwardly (angle β'), and downwardly (angle π) when viewed in side elevation view, from intersecting said forward edge (138*a*) of said bottom wall (138), at said curved bottom ends (140*e*, 142*e*), to top ends (140*d*, 142*d*) of said curved end walls (140, 142) so that the forward edge of said top ends (140*d*, 142*d*) of said curved end walls (140, 142) cut back and down to intersect said forward edge (132*a*) of said top wall (132), and wherein said curved end walls (140, 142), including longitudinal outermost tips (140*h*, 142*h*) of said curved end walls (140, 142), extend longitudinally parallel to axis C' beyond corresponding said left and right ends (132*b*, 132*c*) of said top wall (132).

2. The bucket of claim 1 wherein said curved end walls curve upwardly towards said plane of said top wall so as to intersect said plane approximately orthogonally.

3. The bucket of claim 1 wherein said curved end walls are each formed of a plurality of substantially planar segments so as to form seamed curved walls having seams at boundaries between said segments.

4. The bucket of claim 3 wherein said plurality of substantially planar segments includes at least six said segments.

5. The bucket of claim 1 wherein said second portions of said bucket each form a scoop having said end longitudinal axis declined relative to said central longitudinal axis and said first portion.

6. The bucket of claim 5 wherein said pair of end longitudinal axes are diverging relative to each other and relative to said first portion.

7. The bucket of claim 1 wherein said coupler is a pivotable coupler mounted to said top wall for pivotally mounting said top wall to the actuable arm of the ditch digging apparatus so that one of said curved end walls is rotatable downwardly relative to and about the longitudinal axis of the actuable arm while simultaneously said first portion is rotated upwardly relative to the arm.

8. The bucket of claim 1 wherein said second portions are approximately conical.

* * * * *